US007080849B2

(12) United States Patent
Lammer

(10) Patent No.: US 7,080,849 B2
(45) Date of Patent: Jul. 25, 2006

(54) SKI, METHOD OF STIFFENING THE SKI AND METHOD OF MANUFACTURING THE SKI

(75) Inventor: Herfried Lammer, Lauterbach (AT)

(73) Assignee: Head Sport AG, Kennelbach (AT)

( * ) Notice: Subject to any disclaimer, the term of this patent is extended or adjusted under 35 U.S.C. 154(b) by 165 days.

(21) Appl. No.: 10/339,486

(22) Filed: Jan. 10, 2003

(65) Prior Publication Data

US 2003/0155740 A1 Aug. 21, 2003

(30) Foreign Application Priority Data

Jan. 14, 2002 (EP) ..... 02000815

(51) Int. Cl.
*A63C 5/07* (2006.01)

(52) U.S. Cl. ..... 280/602; 280/610; 310/326

(58) Field of Classification Search ..... 280/601, 280/602, 610, 809; 310/317, 326, 327, 328
See application file for complete search history.

(56) References Cited

U.S. PATENT DOCUMENTS

| | | | |
|---|---|---|---|
| 3,582,691 | A | 6/1971 | Sonderegger et al. |
| 4,402,524 | A | 9/1983 | D'Antonio et al. |
| 4,706,985 | A | 11/1987 | Meatto |
| 5,499,836 | A | 3/1996 | Juhasz |
| 5,590,908 | A | 1/1997 | Carr |
| 5,615,905 | A | 4/1997 | Stepanek et al. |
| 5,656,882 | A | 8/1997 | Lazarus et al. |
| 5,687,462 | A | 11/1997 | Lazarus et al. |
| 5,775,715 | A | 7/1998 | Vandergrift |
| 5,779,257 | A | 7/1998 | Bonvallet et al. |
| D404,100 | S | 1/1999 | Lazarus et al. |
| 5,857,694 | A | 1/1999 | Lazarus et al. |
| 5,869,189 | A | 2/1999 | Hagood, IV et al. |
| 6,048,622 | A | 4/2000 | Hagood, IV et al. |
| 6,069,433 | A | 5/2000 | Lazarus et al. |
| 6,086,490 | A | 7/2000 | Spangler et al. |
| 6,095,547 | A | 8/2000 | Vandergrift et al. |
| 6,102,426 | A | 8/2000 | Lazarus et al. |
| 6,196,935 | B1 | 3/2001 | Spangler et al. |
| 2004/0152544 | A1 | 8/2004 | Lammer |

FOREIGN PATENT DOCUMENTS

| | | |
|---|---|---|
| DE | 25 02 031 | 7/1976 |
| DE | 41 05 759 A1 | 8/1992 |
| DE | 197 44 344 C1 | 4/1999 |
| EP | 0 162 372 A2 | 11/1985 |

(Continued)

*Primary Examiner*—Christopher P. Ellis
*Assistant Examiner*—Brian Swenson
(74) *Attorney, Agent, or Firm*—Finnegan, Henderson, Farabow, Garrett & Dunner LLP

(57) ABSTRACT

The present invention generally relates to boards for performing skiing such as downhill skis, cross-country skis, snowboards and the like, to a method of stiffening such boards, and a method of manufacturing such boards. More specifically, the present invention relates to a downhill ski comprising electronics for establishing optimal handling and performance characteristics. The board for performing skiing sports of the present invention generally comprises a longitudinally extending body having a longitudinal axis, at least one transducer laminated to the body and converting upon deformation of the body mechanical power to electrical power, and an electrical circuit connected across the transducer. The electrical circuit supplies power to the transducer, wherein all electrical power supplied to the transducer is derived from power extracted from the mechanical deformation, and the transducer converts the electrical power to mechanical power, wherein the mechanical power is adapted to actively stiffen the board.

21 Claims, 21 Drawing Sheets

FOREIGN PATENT DOCUMENTS

| | | | |
|---|---|---|---|
| EP | 0 841 969 | B1 | 5/1998 |
| EP | 0 963 768 | A1 | 12/1999 |
| EP | 0 970 727 | A1 | 1/2000 |
| EP | 1 080 746 | A1 | 3/2001 |
| FR | 2 643 430 | | 8/1990 |
| FR | 2 741 274 | | 5/1997 |
| SE | 465 603 | | 10/1991 |
| WO | WO 95/20827 | | 8/1995 |
| WO | WO 97/04841 | | 2/1997 |
| WO | WO 97/11756 | | 4/1997 |
| WO | WO 98/34689 | | 8/1998 |
| WO | WO 99/21626 | | 5/1999 |
| WO | WO 99/51310 | | 10/1999 |
| WO | WO 99/52606 | | 10/1999 |
| WO | WO 00/45067 | A1 | 8/2000 |
| WO | WO 00/51190 | | 8/2000 |
| WO | WO 00/74224 | A1 | 12/2000 |

Damping Ratio calculated using the Filtered Signal

PRIOR ART

Damping Ratio calculated using the Filtered Signal

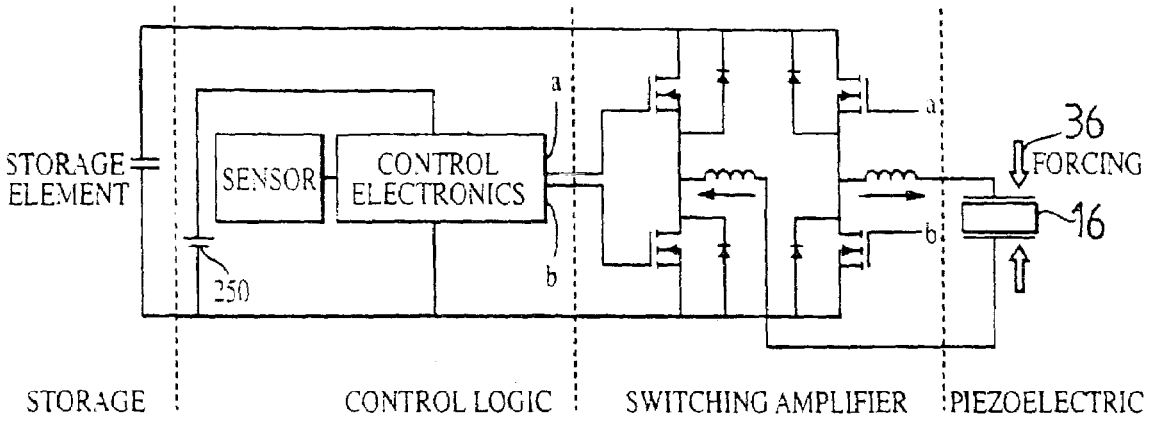
Figure 13
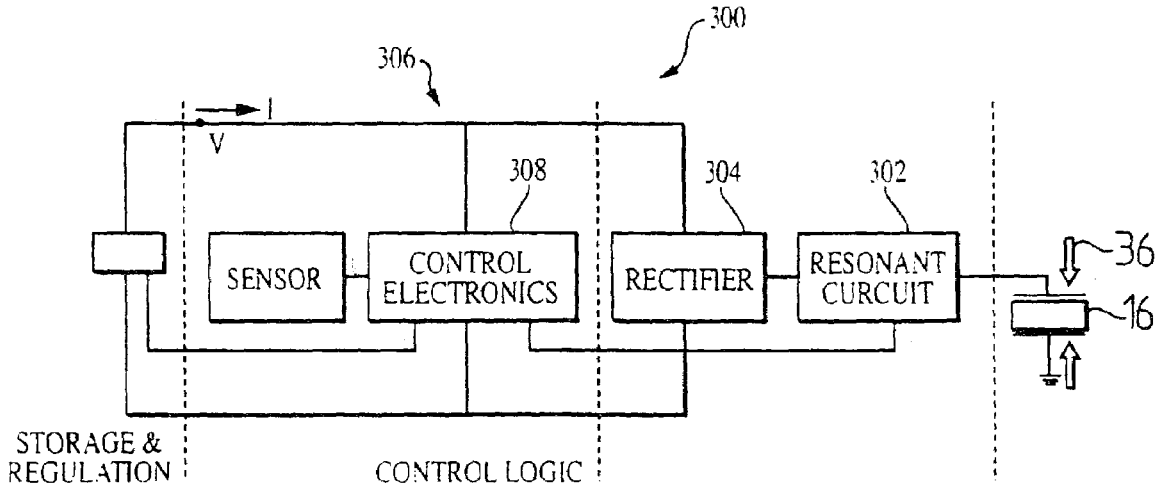
Figure 14A
Figure 14B
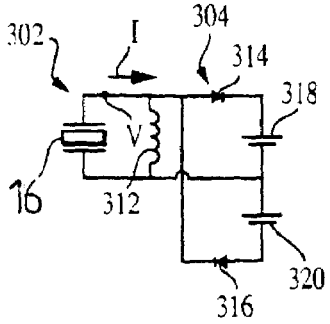

Figure 19
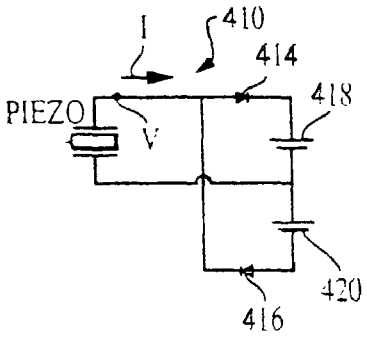
Figure 20A
Figure 20B
Figure 20C
Figure 20D
Figure 20E
Figure 20F
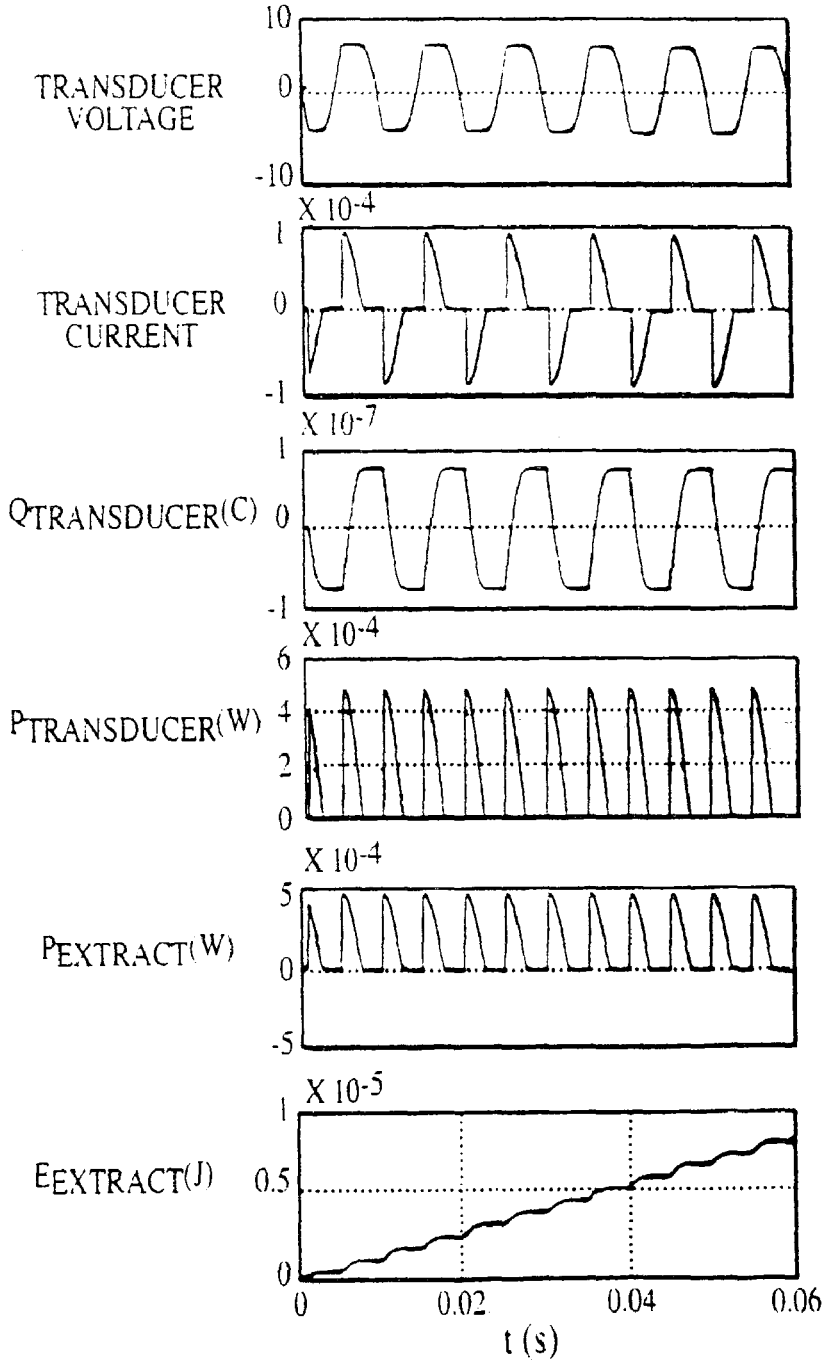

SKI, METHOD OF STIFFENING THE SKI AND METHOD OF MANUFACTURING THE SKI

CROSS REFERENCE TO RELATED APPLICATIONS

This application is based upon and claims the benefit of priority from the prior European Patent Application No. 02 00 0815.1, filed on Jan. 14, 2002, the entire contents of which are incorporated herein by reference.

The present invention generally relates to boards for performing skiing such as downhill skis, cross-country skis, snowboards and the like, to a method of stiffening such boards, and a method of manufacturing such boards. More specifically, the present invention relates to a downhill ski comprising electronics for establishing optimal handling and performance characteristics.

In the prior art, several sports implements including electronics are known. For example, WO-A-97/11756 and corresponding U.S. Pat. No. 5,857,694 relate to a sports implement comprising a unitary sports body, an electroactive assembly including a piezoelectric strain element for transducing electrical energy and mechanical strain energy, and a circuit connected to the assembly for directing electrical energy via the assembly to control strain in the piezoelectric element so as to damp vibrational response of the body. The electroactive assembly is integrated into the body by a strain coupling. The assembly may be a passive component, converting strain energy to electrical energy and shunting the electrical energy, thus dissipating energy in the body of the sports implement. In an active embodiment, the system includes an electroactive assembly with piezoelectric sheet material and a separate power source such as a replaceable battery. In a ski, the electroactive element is located near to the root in a region of high strain to apply damping, and the element is said to capture between about one and five percent of the strain energy of the ski. The region of high strain may be found by modeling mechanics of the sports implement, or may be located by empirically mapping the strain distribution which occurs during use of the implement. In other embodiments, the electroactive elements aim at removing resonances, adapting performance to different situations, or enhancing handling or comfort of the implement.

A similar sports implement is described in WO-A-98/34689. It includes a strain transducer material, such as layer containing a piezoceramic, mechanically coupled over a region of its body, and a circuit attached to or switched across the material to couple strain energy out of the implement and enhance its performance. For a ski, one effective circuit is a low Q resonant inductive shunt tuned to a performance band of the ski which enhances dissipation of energy in a neighborhood of a structural mode of the ski. The mode may be selected based on detected or anticipated conditions, while the neighborhood may be defined to include variations in the frequency of a first or higher free structural resonance which arise from production variations or size variations of the ski or its components. The neighborhood may also be selected to cover the range of frequencies that mode takes when driven by actual disturbances in use, such as the vibrations excited when skiing at a particular range of speeds, or with a particular sat of snow conditions, or a combination of conditions of temperature, speed, snow and terrain. Further similar sports implements are disclosed in WO-A-99/51310 and WO-A-99/52606.

These known sports implements do not provide satisfying handling and performance properties, e.g., damping characteristics. A further disadvantage of the prior art devices is that the electronics either simply dissipates the generated electrical energy by means of a shunt (e.g. resistor or LED) in the form of a passive assembly, or an additional power source (e.g. battery) is needed in order to supply the electronics with electrical energy so as to form an active assembly. Both known alternatives are, however, not completely satisfying with respect to efficiency, performance, handling characteristics and manufacturing aspects.

WO-A-97/04841 and corresponding EP-B-0 841 969 and U.S. Pat. No. 5,775,715 relate to a board, such as a ski or snowboard, that includes a piezoelectric damper. The piezoelectric damper is located on the body of the board such that, as the board vibrates or deforms, the piezoelectric material is also deformed. As the piezoelectric material deforms, it produces an electrical signal that is provided to a control circuit. The control circuit receives the electrical signal and either provides a resistance to the electrical signal or provides a control signal to the piezoelectric material. The resulting resistance or control signal causes the piezoelectric material to resist the deformation of the board, thus acting as a damper. The piezoelectric damper may be located between the bindings on the board, or may be located in front of the forward binding, behind the aft binding, or in more than one location. In the preferred embodiment, the piezoelectric damper is formed of one or more layers of piezoelectric material on which an electrical grid has been mounted. The piezoelectric material and electrical grid are encapsulated within an organic matrix, such as an epoxy or plastic resin. One substantial disadvantage of this board is that the oscillation is simply dampened without considering the consequences for the performance of the board in detail. More precisely, the oscillation of the board is excessively dampened so that the stiffness of the board suffers.

It is therefore an object of the present invention to provide an improved board such as a ski or snowboard, an improved method of stiffening a board, and a method for manufacturing such a board. In particular, there is still a need for improved handling and performance characteristics of such boards. This object and need is achieved with the features of the claims.

In accordance with the present invention, the board is provided with a self-powered electronics being connected to at least one transducer arranged on the board. More particularly, in accordance with the present invention there is provided a board for performing skiing sports comprising a longitudinally extending body having a longitudinal axis, at least one transducer laminated to the body and converting upon deformation mechanical energy or power to electrical energy or power, and an electrical circuit connected across the transducer. The electrical circuit supplies energy or power to the transducer, wherein all electrical energy or power supplied to the transducer is derived from energy or power extracted from the mechanical deformation. The transducer converts electrical energy or power to mechanical energy or power, wherein the mechanical energy or power is adapted to actively stiffen the board.

In a preferred embodiment, the electrical connection between the at least one transducer and the electrical circuit is established by means of laminated flex circuits, i.e. a substantially flat wiring arrangement that can be laminated to the body of the board. The at least one transducer typically has an elongate shape, preferably rectangular shape, and is laminated to the body adjacent a running surface of the board. Preferably the transducer is laminated inside the body between a core layer and the running surface of the ski. Two transducers are preferably provided on the body of the board that are electrically connected to the same electrical circuit. It is furthermore preferred that each of the elongate transducers is provided on the body of the board substantially parallel to the running surface and under an angle of about 30° to 60°, preferably about 45° with respect to the longitudinal axis of the board. The two transducers are preferably provided perpendicularly with respect to one another and each obliquely with respect to the longitudinal axis of the body. The two or more transducers may be spaced from one another in the longitudinal direction of the board or may cross each other, i.e., be provided at substantially the same position along the longitudinal axis of the board.

The transducer(s) used on the board of the invention is typically most useful if arranged at an antinodal point of a torsional oscillation, or a region of maximum amplitude of the oscillation or vibration of the board, and the electrical circuit is adapted to minimize or suppress a first mode of said torsional oscillation. The at least one transducer and the electrical circuit are preferably adapted to stiffen the board in a frequency range between 60 and 180 Hz, preferably between 85 and 120 Hz. It is preferred that the at least one transducer and the electrical circuit are adapted to reduce the oscillation amplitude by a factor of at least 1.5, preferably 2.0. The board of the present invention may achieve a damping ratio in the range of between 0.0050 and 0.0100, preferably between 0.0065 and 0.0075 and more preferred of about 0.0071.

Typically, the electrical circuit comprises a storage element for storing power extracted from the transducer. The transducer is preferably at least one of a piezoelectric, an antiferroelectric, an electrostrictive, a piezomagnetic, a magnetostrictive, a magnetic shape memory and a piezoceramic material. The transducer is typically in the form of a flat sheet, with a size of each of the transducers typically about 8 to 16 $cm^2$, preferably about 10 to 14 $cm^2$, and most preferably about 12 $cm^2$.

Furthermore, in accordance with the present invention, the above need is achieved with a method of stiffening the board for performing skiing sports comprising the steps of converting mechanical power induced in at least one transducer laminated to the board upon deformation of the board to electrical power, supplying the electrical power to an electrical circuit connected across the transducer, supplying power from the electrical circuit to the transducer, wherein all electrical power supplied to the transducer is derived from power extracted from the mechanical deformation, and converting the electrical power to mechanical power by the transducer so that said board is actively stiffened by counteraction of the transducer against the deformation.

The board of the present invention is preferably manufactured by the steps of providing a recess in the board for receiving the electrical circuit, mounting the electrical circuit into the recess, providing the at least one transducer and an electrical connection between the transducer and the electrical circuit, and laminating the transducer and the electrical circuit to the board by applying pressure and/or heat.

Preferably, the recess is provided in a binding receiving area of the board, particularly inbetween two binding receiving areas for a front part and a rear part of a binding. The two transducers are advantageously provided on the board inclined with respect to a longitudinal axis of the board so that the transducers preferably are arranged perpendicularly with respect to one another.

In a preferred embodiment, the transducer is a composite for actuating or sensing deformation of a structural member comprising a series of flexible, elongated fibers arranged in a parallel array. Each fiber is substantially in parallel with each other, with adjacent fibers being separated by a relatively soft deformable polymer having additives to vary the electric or elasticity properties of the polymer. Furthermore, each fiber has a common poling direction. The composite further includes flexible conductive electrode material along the axial extension of the fibers for imposing or detecting electric fields. The electrode material has an interdigitated pattern forming electrodes of opposite polarity that are spaced alternately and configured to apply a field having components along the axes of the fibers. The polymer is interposed between the electrode of the fibers. Preferably, the fibers are electro-ceramic fibers comprising a piezoelectric material. This type of transducer is described in more detail in U.S. Pat. No. 5,869,189.

In the following, further details and advantages of the present invention will be described with reference to preferred embodiments illustrated in the drawings, in which:

FIG. 13 is a circuit diagram of an additional alternative embodiment of a power extraction system;

FIG. 14A is a block diagram of a power extraction system including a resonant circuit and a rectifier;

FIG. 14B is a circuit diagram of a particular embodiment of the power extraction system of FIG. 14A;

FIG. 19 is a circuit diagram of a passive rectifier power extraction system;

FIGS. 20A–20F are various voltage, current, power, and energy waveform diagrams of the circuit of FIG. 19;

Figure 1:
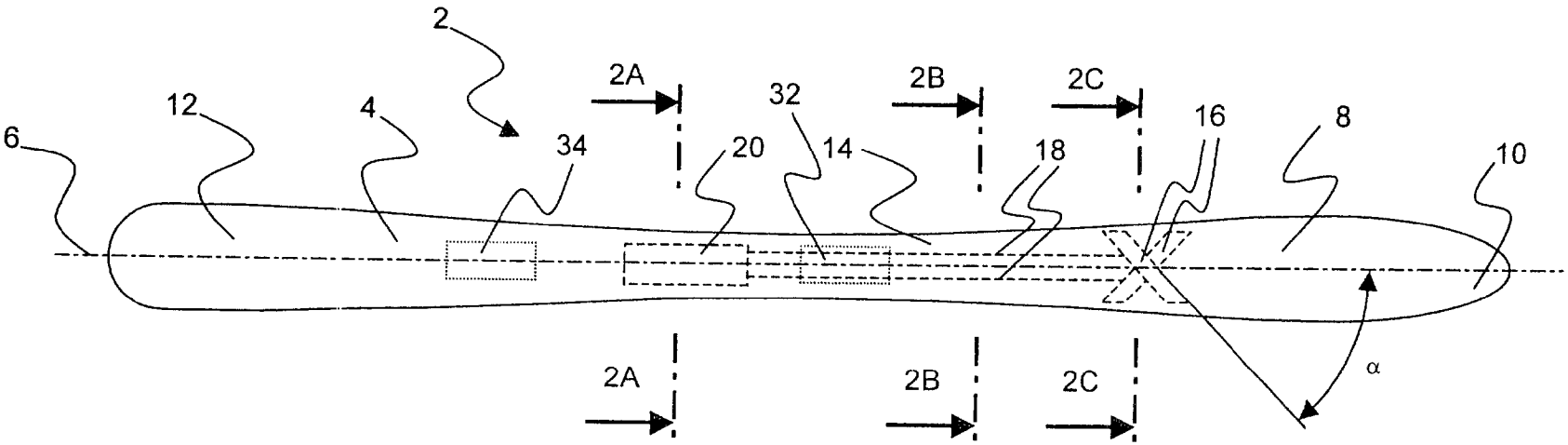
FIG. 1 is a schematic illustration of one embodiment of a ski of the present invention.

In the following a preferred embodiment of the board of the present invention will be described with reference to a ski 2 as schematically shown in FIGS. 1 and 2. Generally, the ski 2 comprises a longitudinally extending body 4 having a longitudinal axis 6. As can be seen in FIG. 1, the ski 2 is illustrated as a carving ski having a first end portion 8 forming a tip 10 of the ski and a second end portion 12, wherein between the end portions 8 and 12 an intermediate portion 14 is present having a width smaller than that of the end portions 8 and 12. However, in accordance with the present invention any other kind of board, e.g., a traditional ski, mono ski or snow board, can be used instead of a carving ski.

Furthermore, the ski 2 comprises at least one transducer 16, preferably two transducers 16 laminated to the body 4. In FIG. 1, two transducers 16 are shown each of which having an elongate shape, preferably a rectangular or parallelogram shape. The transducers 16 are laminated to the body 4 of the ski 2 under an angle $\alpha$ of about 30° to 60°, preferably about 45°, with respect to the longitudinal axis 6 of the ski 2, wherein, when mounted under 45° the two transducers 16 are preferably arranged perpendicularly with respect to one another.

The transducers 16 are adapted to convert upon deformation mechanical power to electrical power and vice versa. Preferably, the transducer 16 is at least one of a piezoelectric, an antiferroelectric, an electrostrictive, a piezomagnetic, a magnetostrictive, a magnetic shape memory and a piezoceramic material. The size of the area of each of the sheet-like transducers 16 is typically about 8 to 16 $cm^2$, preferably about 10 to 14 $cm^2$, and most preferably about 12 $cm^2$.

The transducers 16 are laminated to the body 4 of the ski 2 and electrically connected via a respective (or common) electrical connection 18 to a self-powered electrical circuit 20 mounted on an electronics board (not shown). The transducers 16 in combination with the self-powered electrical circuit 20 are intended to improve the performance of the ski 2 of the present invention. In particular, these elements are intended to reduce oscillation and/or vibrations generated during skiing. For example, when a downhill skier uses the ski 2 of the present invention that incorporates the transducers 16 and the self-powered electrical circuit 20, oscillations or vibrations generated during the sliding movement of the ski 2 on the ground (e.g., snow or ice) are used to deform the transducers and to extract energy from the transducers 16. This energy is then transferred via the electrical connection 18 to the electrical circuit 20 that in turn sends a signal back to the transducers 16 to actuate them so as to actively stiffen the ski 2.

Figure 2C:
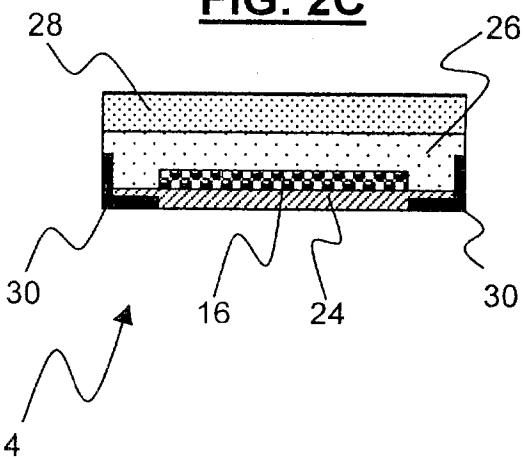
FIG. 2C is a cross-sectional view taken along line 2C—2C of FIG. 1 showing how the transducers are laminated to the body of the ski.
Figure 2B:
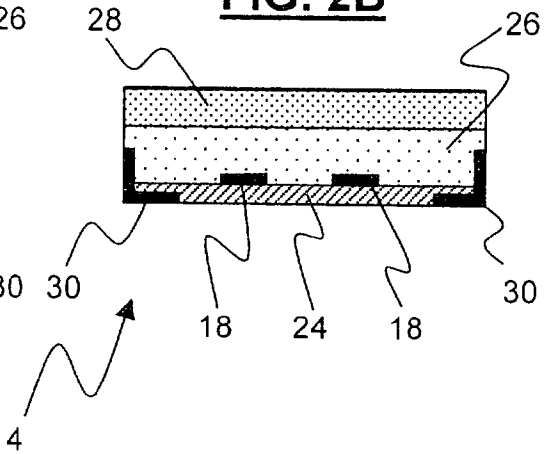
FIG. 2B is a cross-sectional view taken along line 2B—2B of FIG. 1 showing how the electrical connections between the electrical circuit and the transducers are laminated to the body of the ski.
Figure 2A:
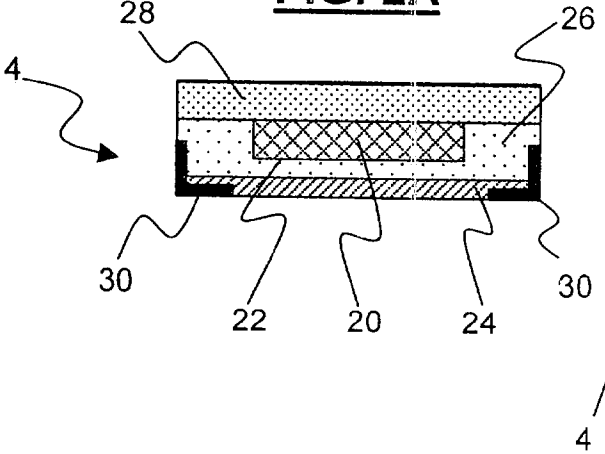
FIG. 2A is a cross-sectional view taken along line 2A—2A of FIG. 1 showing how the electrical circuit is mounted to the body of the ski.

As shown in FIGS. 2A, 2B and 2C, the body 4 of the ski 2 preferably comprises a recess or cut-out 22 in which the self-powered electronics board carrying the electrical circuit 20 is arranged. The recess 22 is preferably formed somewhere inbetween a running surface layer 24 and a top layer 28 of the ski 2 of the present invention during the manufacturing process of the body 4. As can be seen in the cross-section of FIGS. 2A to 2C, the body 4 of the ski 2 has a laminated construction that may comprise a plurality of layers 24, 26, 28 (only three of which are schematically shown) which can be conventionally laminated by means of a press, preferably a heated press. Furthermore, the ski 2 may comprise a lining or bordering 30 at each of the longitudinal edges of the body 4 as is well known in the art.

The self-powered electrical circuit 20 is provided on the electronics board on which the components of the circuit are mounted. Preferably, the circuit board also carries a storage element for storing power extracted from the transducer 16. In accordance with a preferred embodiment of the present invention, the recess 22 is at least partially filled with a material after the electrical circuit 20 has been arranged therein so as to fix the electrical circuit 20 in place. Preferably, the material fixing the electrical circuit 20 in the recess 22 is a foam that may be filled in the recess 22 and expands its volume so as to fill the cavity in the body 4 of the ski 2 at least partially. Alternatively or additionally, the electrical circuit 20 may be mounted to the body 4 by means of an adhesive in the recess 22. Alternatively, the electrical circuit 20 could be arranged at any other location on the body 4, e.g., the electrical circuit 20 may be arranged outside the body 4 of the ski 2. In any of these configuration the electrical circuit 20 may be provided as an integrated chip (IC) that is visible through the body 4 of the ski 2 from the outside.

Referring again to FIG. 1, it can be seen that the electrical circuit 20 is provided in a binding receiving area of the ski 2. The binding receiving area comprises a first receiving area 32 adapted to receive a front part of a binding and a second receiving area 34 adapted to receive a rear part of the binding, wherein the electrical circuit 20 is arranged between the first and second binding receiving areas 32 and 34.

The ski 2 of the present invention is particularly adapted to stiffen the body 4 against torsional deformation typically occurring during skiing. Therefore, the at least one transducer 16 is preferably mounted in a region of the ski 2 where maximum torsional deformation occurs, i.e. the transducer(s) 16 are arranged in an antinodal point of a torsional oscillation and the electrical circuit 20 is preferably adapted to supply a signal to the transducer(s) so as to minimize or suppress a first mode of this torsional oscillation. Furthermore, it is advantageous to provide the transducers 16 on the front surface or the opposite back surface of the ski 2 since maximum deformation can be expected at the largest possible distance from the elastic line of the body 4. Therefore, in accordance with the present invention the transducers 16 are preferably laminated adjacent the running surface layer 24 of the ski 2 (FIG. 2C). In the illustrated embodiment of FIG. 2C, the transducer 16 is laminated inside the body 4 between the core layer 26 and the running surface layer 24 of the ski 2, wherein the transducer 16 is slightly inserted in the core layer 26. Alternatively, the transducer 16 may project into the running surface layer 24 or in both the core layer 26 and the running surface layer 24.

Furthermore, it is assumed that the maximum torsional deformation of the ski body 4 is generated during skiing in or adjacent the first end portion or front portion 8 of the ski 2. Within the gist of the present invention it is also possible to provide one transducer 16 or one pair of transducers 16 adjacent the running surface layer 24 and further transducer(s) 16 on the opposite side of the elastic line of the body 4 of the ski, e.g., adjacent an upper surface of the ski body 4. In other words, one or more of the transducers 16 may be provided on one or both sides of the elastic line of the ski 2. For instance, a plurality of transducers 16 may be provided, e.g., stacked, adjacent each of the upper and lower surfaces of the ski 2 to improve its performance.

The at least one transducer 16 laminated to the ski body 4 preferably comprises silver ink screen-printed interdigitated electrodes (IDE) on polyester substrate material, unidirectionally aligned PZT-5A lead based piezoelectric fibers and thermoset resin matrix material. As already mentioned above, the transducers 16 have a two-fold purpose of sensing and actuating. They are used to sense strain in the ski body 4 and provide an electrical output via an electrode subsystem to the electrical circuit 20. They are also used to actuate the ski body 4 once motion deformation has been detected. The fibers, preferably piezoelectric fibers act as transducers 16 and convert mechanical deformation into electrical energy and vice versa. When deformed, they develop a surface charge and, conversely, when an electric field is applied, a deformation is induced. The mechanical strains in the ski 2 during its use deform the transducer 16, straining the piezoelectric fibers. The interdigitated electrode picks up the surface charges developed by the strained piezoelectric fibers and provides an electric path for the charges to be routed to appropriate electrical circuit 20. Conversely, the interdigitated electrode also provides the electrical path to drive the piezoelectric fibers in the transducer 16 to counteract the vibrations induced in the ski 2.

The presently preferred transducers 16 are manufactured in that the piezoelectric fibers and the matrix resin are laminated between two IDE electrodes under specified pressure, temperature and time profiles. The IDE pattern may be used on one or both sides of the composite. The laminated composite is poled at high voltage at specified temperature and time profiles. This process establishes a polar mode of operation of the transducers 16, necessitating the need to track electrical "ground" polarity on the transducer 16 power lead tabs. More details about this type of transducer 16 and its manufacture may be found in U.S. Pat. No. 5,869,189. A commercially available transducer which is presently preferred to be used with the present invention is an active fiber composite ply known as "Smart Ply" (Continuum Control Corporation, Billerica, Mass., U.S.A.).

Referring to FIG. 2B, it can be seen that the electrical connection 18 between the transducers 16 and the electrical circuit 20 is preferably established by means of so-called "flex circuits". For example, such a flex circuit comprises a silver ink screen-printed set of traces on polyester substrate material. A layer of insulating material is applied to the conducting traces except for a region at the tabs or terminal ends of the traces. At one end of the trace, the exposed conductive trace is matched in shape to a tab or terminal end of the transducer 16. Solderable pins are crimped to the exposed conductive traces at the other end of the trace. Preferably, a bent is provided in this end region of the trace to effectively route the flex circuit into the recess 22 for the electronics board carrying the electrical circuit 20 provided in the body 4 of the ski 2. The flex circuit can thus be laminated to the body 4 preferably adjacent the running surface 24 of the ski 2 as is illustrated in FIG. 2B.

The electrical circuit 20 used with the ski 2 of the present invention is a self-powered electronics, i.e. no external energy source like a battery is necessary. Preferably, the electrical circuit 20 comprises a printed wiring board (PWB) populated with active and passive components using standard surface mount technology (SMT) techniques. The components of the electrical circuit i.a. include high-voltage MOSFETs, capacitors, resistors, transistors and inductors. The circuit topology used is described in detail below.

The purpose of the electrical circuit or electronics board 20 is to extract the charge from the transducer actuators, temporarily store it, and re-apply it in such a way as to actively stiffen the ski or board, particularly with respect to torsional deformation. The electronics operate by switching twice per first mode cycle at the peak of the voltage waveform. The switching phase shifts the transducer terminal voltage by 90° referenced to the theoretical open circuit voltage. This phase shift extracts energy from the transducer 16 and the ski 2. The extracted energy increases the terminal voltage by biasing the transducer actuators. The voltage does not build to infinity due to finite losses in the MOSFETs and other electronic components. The switching occurs until enough energy is extracted to stiffen the ski 2 or dampen the oscillation, e.g., to approximately 35%, preferably 25% of the initial amplitude.

For example, the transducer 16 may be a piezoelectric transducer, an antiferroelectric transducer, an electrostrictive transducer, a piezomagnetic transducer, a magnetostrictive transducer, a magnetic shape memory transducer or a piezoceramic transducer.

The at least one transducer 16 and preferably also the flex circuit 18 are laminated to the ski body 4 with a suitable resin material under specific temperature, pressure and time profiles. Preferably, the at least one transducer 16 is laminated to the body 4 by means of the same resin as used for the manufacture of the body 4 itself. The lamination of the transducers 16 and the flex circuit 18 may either be carried out simultaneously or in an additional step after the body 4 has been manufactured. After lamination of the transducer 16 and flex circuit 18 to the ski body 4, an additional protective coating may be applied above the transducer 16 and/or flex circuit 18. The protective coating may comprise, e.g., glass cloths or glass fiber mats and/or a lacquer a varnish. It is preferred that each of the transducers 16 mounted to the ski 2 of the present invention has a size of about 8 to 16 $cm^2$, preferably about 10 to 14 $cm^2$ and most preferably about 12 $cm^2$. The electrical connections 18 between the transducer(s) 16 and the electrical circuit 20 are preferably laminated between the core layer 26 and the running surface layer 24 as shown in FIG. 2B.

Figure 5A:
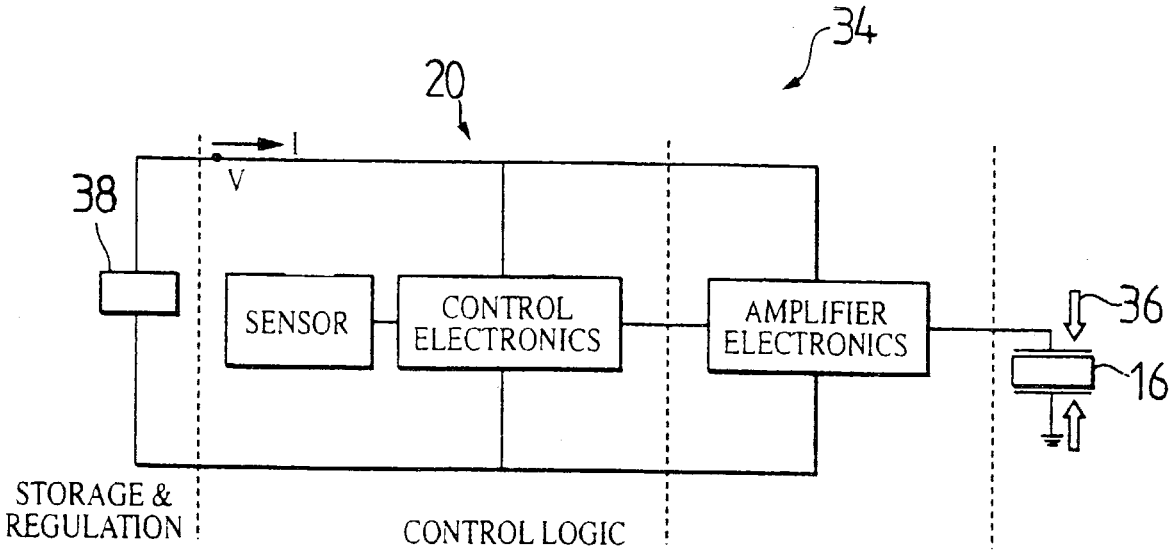
FIG. 5A is a block diagram of an embodiment of a power extraction system which may be used with the ski of the invention.

In the following, preferred embodiments of the electrical circuit 20 will be described with reference to FIGS. 5A to 34. Referring to FIG. 5A, an electronic circuit 34 for extracting electrical power from a transducer 16 acted upon by a disturbance 36, e.g., a deformation of the ski 2 in response to skiing, includes amplifier electronics, for example, any amplifier that allows bi-directional power flow to and from transducer 16 such as a switching amplifier, a switched capacitor amplifier, or a capacitive charge pump; control logic; and a storage element 38, for example, a capacitor. Amplifier electronics provides for flow of electrical power from transducer 16 to storage element 38, as well as from storage element 38 to transducer 16.

Figure 5B:
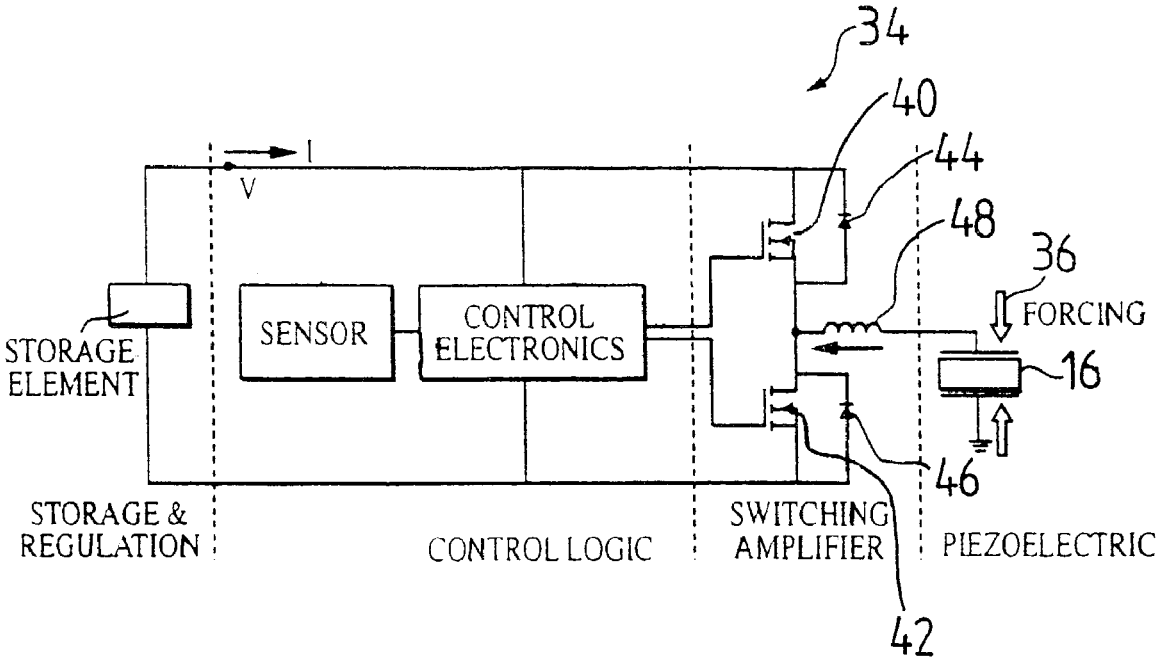
FIG. 5B is a circuit diagram of a particular embodiment of the power extraction system of FIG. 5A.

Referring to FIG. 5B, a switching amplifier includes switches, for example, MOSFETs 40 and 42, bipolar transistors, IGBTs, or SCRs, arranged in a half bridge, and diodes 44 and 46. (Alternatively the switches can be bidirectional with no diodes.) MOSFETs 40, 42 are switched on and off at high frequencies of, for example, between about 10 kHz–100 kHz. The switching amplifier connects to transducer 16 through an inductor 48. The value of inductor 48 is selected such that inductor 48 is tuned below the high frequency switching of MOSFETs 40, 42 and above the highest frequency of importance in the energy of disturbance 36 with inductor 48 acting to filter the high frequency switching signals of circuit 34.

The current flow through inductor 48 is determined by the switching of MOSFETs 40, 42 and can be divided into four phases:

- Phase I: MOSFET 40 is off, MOSFET 42 is switched on, the current in inductor 48 increases as the inductor stores energy from transducer 16.
- Phase II: MOSFET 42 is turned off and MOSFET 40 is switched on, the current is forced through diode 44 and onto storage element 38 as inductor 48 releases the energy.
- Phase III: As the current in inductor 48 becomes negative the current stops flowing through diode 44 and flows through MOSFET 40, and energy from storage element 38 is transferred to inductor 48.
- Phase IV: MOSFET 40 is then turned off and MOSFET 42 is turned on, current flowing through diode 46 increases, and the energy stored in inductor 48 is transferred to transducer 16.

Figure 6A:
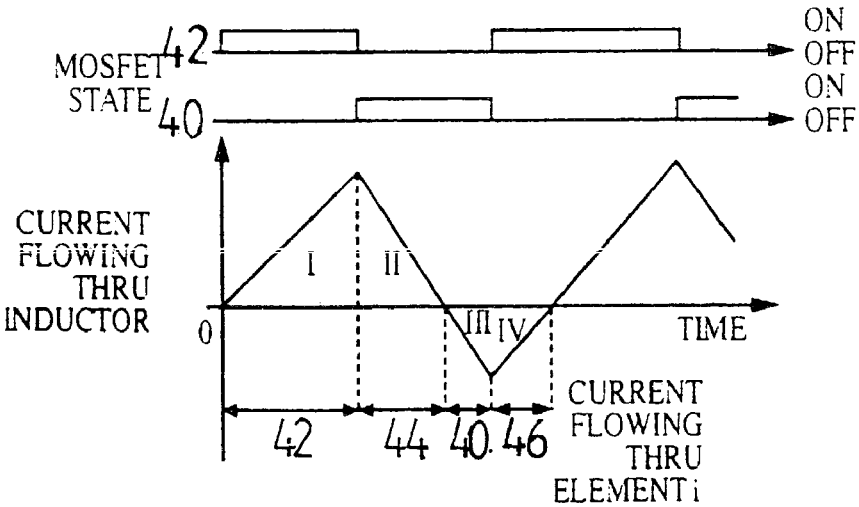
FIG. 6A is a graph of the phases of current flow through an inductor of the circuit of FIG. 5B.
Figure 6B:
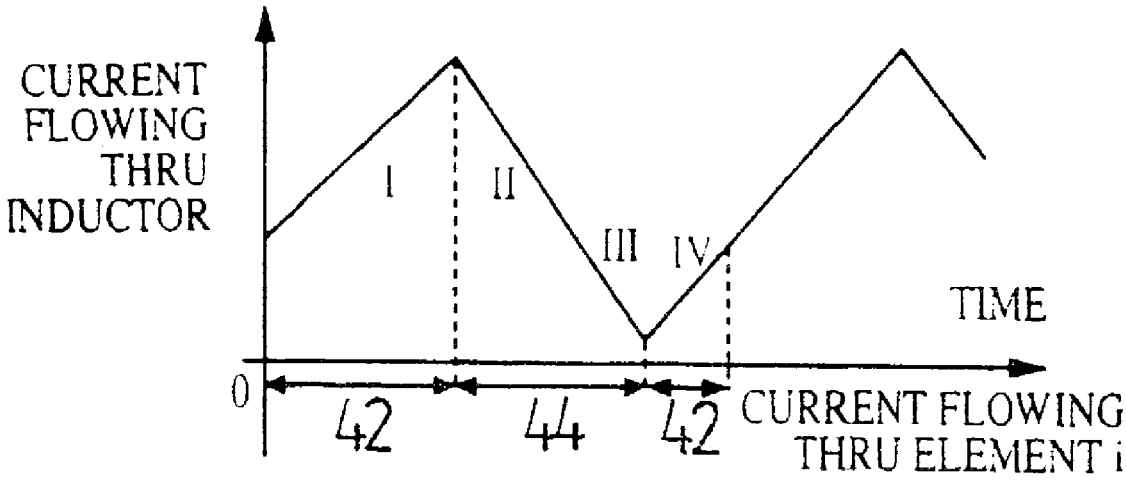
FIGS. 6B and 6C show alternative current flows through the inductor.
Figure 6C:
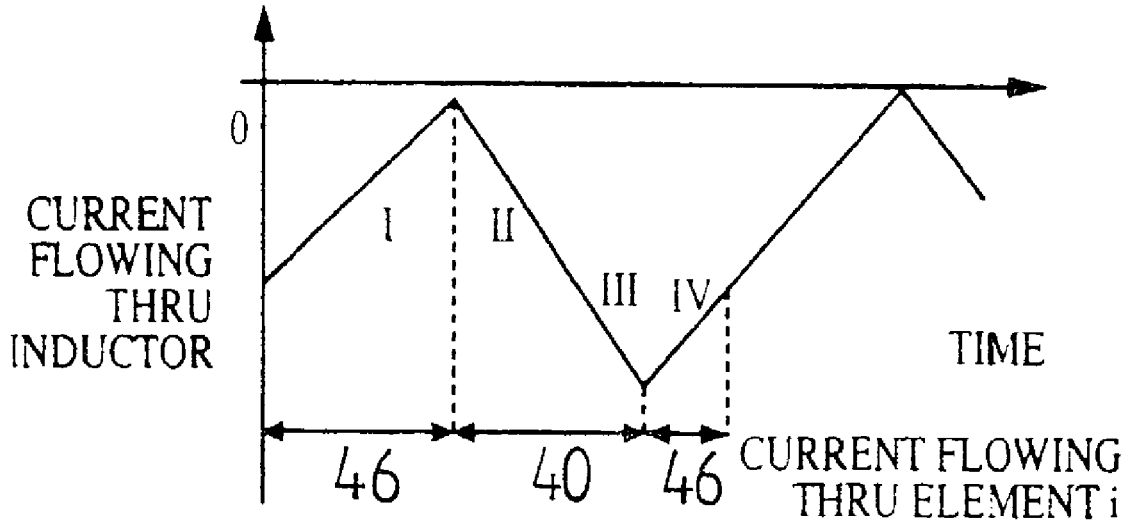

FIG. 6A is a graphical representation of the four phases showing (i) the current through inductor 48 versus time, (ii) which MOSFET or diode current is flowing through in each phase, and (iii) the state of the MOSFETs in each phase. The net current during the switching phases may be positive or negative depending on the state of the disturbance and the duty cycle of the switches. Referring to FIG. 6B, the current may be positive during all four phases in which case the current flows through switch 42 and diode 44. Alternatively, referring to FIG. 6C, the current may be negative during all four phases, in which case the current flows through switch 40 and diode 46.

MOSFET 40 can be off during phase II, and MOSFET 42 can be off during phase IV without affecting the current flow since no current flows through these MOSFETs during the respective phases. If MOSFETs 40, 42 are on during phases II and IV, respectively, a deadtime can be inserted between the turning off of one MOSFET and the turning on of another MOSFET to reduce switching losses from cross conductance across MOSFETs 40, 42.

Figure 7A:
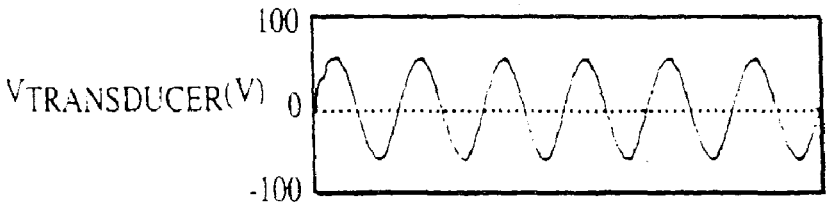
FIGS. 7A–7G are various voltage, current, power, and energy waveform diagrams of the circuit of FIG. 5B.
Figure 7B:
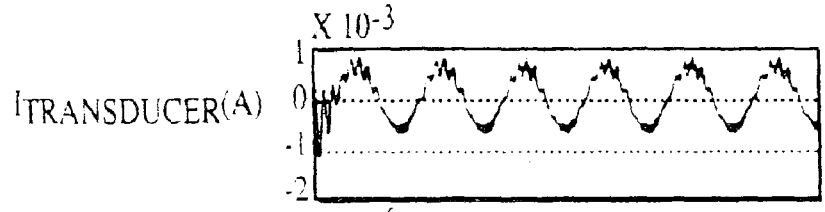
Figure 7C:
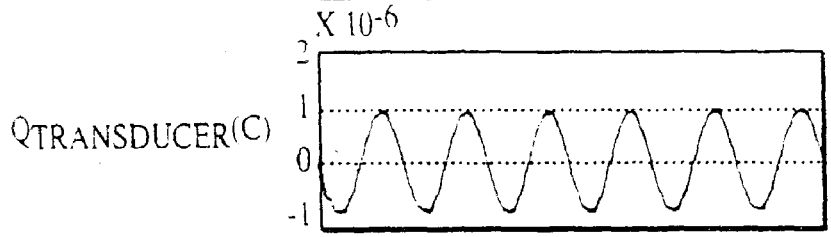
Figure 7D:
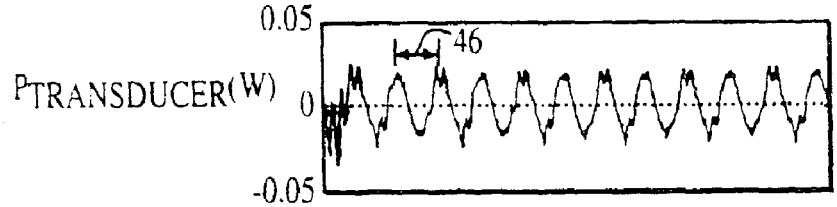
Figure 7E:
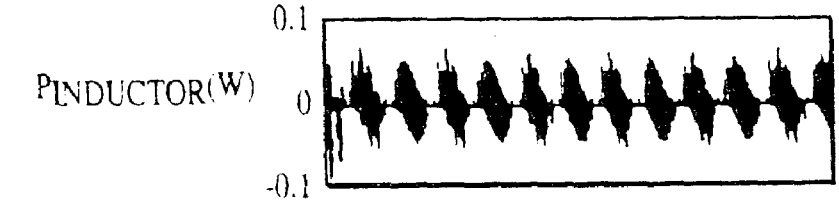
Figure 7F:
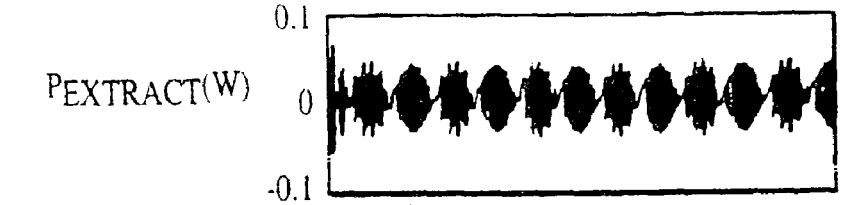
Figure 7G:
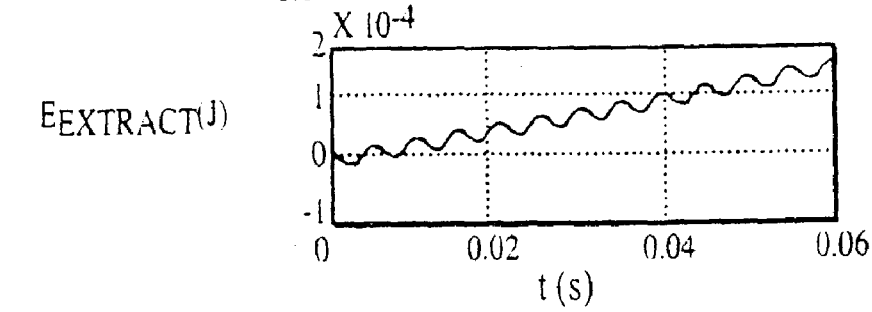
Figure 8A:
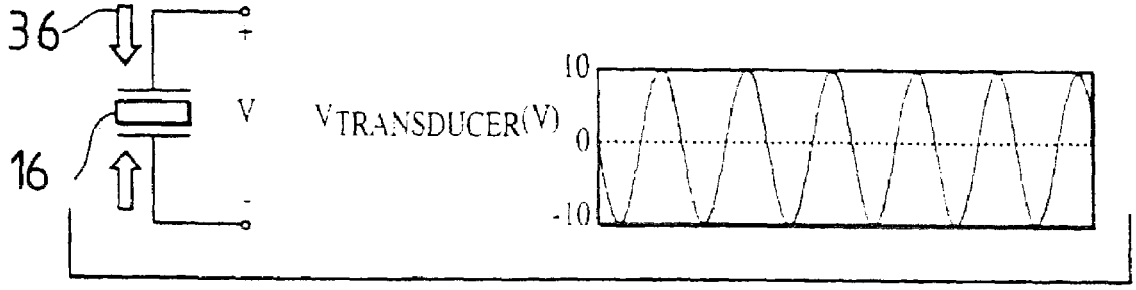
FIG. 8A is a waveform of the voltage across an open circuit transducer.
Figure 8B:
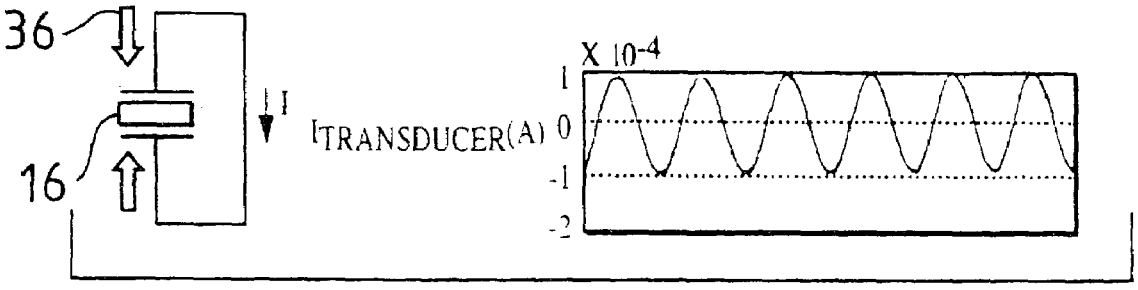
FIG. 8B is a waveform of the current passing through a short circuit transducer.
Figure 8C:
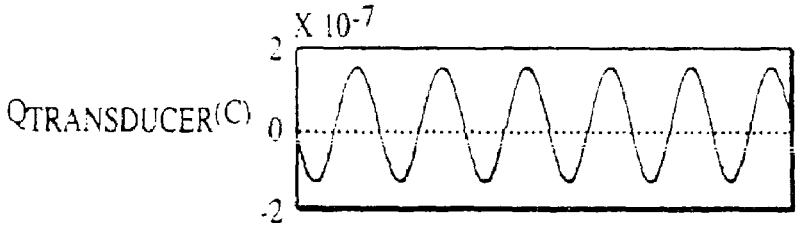
FIG. 8C is a waveform of the charge passing through a short circuit transducer.

Referring to FIGS. 7A to 7G, an example of the power extracted from transducer 16 is graphically represented where the amplitude of the voltage across an open circuit transducer would have been 10 volts (see FIG. 8A). In this example, transducer 16 is a PZT-5H piezoelectric transducer with a thickness of 2 mm and an area of 10 $cm^2$. The properties of this transducer are: compliance $S^E_{33}=2.07\times10^{-11}$ $m^2/N$, dielectric $\epsilon^T_{33}/\epsilon_0=3400$, and coupling coefficient $d_{33}=593\times10^{-12}$ mN. The capacitance of this transducer is 15 nF. The following waveforms correspond to a 100 Hz sinusoidal disturbance with an amplitude of 250 N through the thickness direction, which would produce an open circuit voltage of 10 V on the transducer.

FIG. 7A shows the voltage across transducer 16 as a function of time. The peak amplitude of the voltage is greater than twice any peak voltage of an open circuit transducer. Here, the peak amplitude of the voltage is about 60 volts. FIG. 7B shows the current waveform on transducer 16 and FIG. 7C the charge waveform on transducer 16. Due to the flow of current from storage element 38 to transducer 16, the peak of the integral of the current onto and off transducer 16 is greater than two times higher than any peak of an integral of a current of a short circuit transducer due to the disturbance alone (see FIGS. 8B and 8C).

Due to the phasing of the voltage and current waveforms, the power to and from transducer 16, FIG. 7D, alternates between peaks of about 0.021 Watts and −0.016 Watts. Thus, power flows to transducer 16 from storage element 38 and from transducer 16 to storage element 38 during the course of disturbance 36 on transducer 16, for example, during a single sinusoidal cycle, with the net power flowing from transducer 16 to storage element 38. The cycle need not be sinusoidal, for example, where the disturbance has multiple frequency harmonics or broad frequency content such as in a square wave, a triangular wave, a saw tooth wave, and white noise bandwidth limited or otherwise.

The power into inductor 48 is shown in FIG. 7E. The high frequency switching of MOSFETs 40, 42, described above, is seen in the power waveform. Where the waveform is positive, power is being stored in inductor 48, and where the waveform is negative, power is being discharged from inductor 48.

The extracted power and energy are shown in FIGS. 7F and 7G. Over a period of 0.06 seconds, approximately $1.5\times10^{-4}$ Joules of energy are extracted. An advantage of the circuit is that a higher peak voltage and peak charge are seen by the transducer than would otherwise occur and thus higher power can be extracted from the input disturbance. By applying a voltage to transducer 16 having an appropriate amplitude and phasing relative to disturbance 36, transducer 16 will undergo more mechanical deflection under the load than would otherwise occur. Thus, more work is done on transducer 16 by disturbance 36 and more energy can be extracted by the circuit.

Referring again to FIG. 5B, the duty cycle of MOSFETs 40, 42 is controlled by measuring the motion of disturbance 36 and selecting a time-varying duty cycle to match the motion of disturbance 36. This provides for effective power extraction over a wide frequency range of the disturbance. Control logic includes a sensor, for example, a strain gage, micropressure sensor, PVDF film, accelerometer, or composite sensor such as an active fiber composite sensor, which measures the motion or some other property of disturbance 36, and a control electronics. The sensor supplies a sensor signal to control electronics which drive MOSFETs 40, 42 of switching amplifier. System states which the sensor can measure include, for example, vibration amplitude, vibration mode, physical strain, position, displacement, acceleration, electrical or mechanical states such as force, pressure, voltage or current, and any combination thereof or rate of change of these, as well as temperature, humidity, altitude, or air speed orientation. In general any physically measurable quantity can be measured which corresponds to a mechanical or electrical property of the system.

Possible control methods or processes for determining the duty cycle of MOSFETs 40, 42 include rate feedback, positive position feedback, position-integral-derivative feedback (PID), linear quadratic Gaussian (LQG), model based controllers, or any of a multitude of dynamic compensators.

For the example described above with reference to FIGS. 7A to 7G, with a disturbance of 100 Hz, a switching frequency of 100 kHz was used. An inductor value of 1.68 H was selected such that the time constant of inductor 48 and transducer 16 corresponds to 1,000 Hz. The duty cycle of MOSFETs 40, 42 was controlled using rate feedback. The voltage on storage element 38 was set to 60 volts.

Referring to FIG. 5A, in other alternative control methods or processes for extracting power from transducer 16, the duty cycle of controlled switches in the circuit is specified based on the governing equations for a Boost or Buck converter such that the transducer voltage is stepped up or down to the voltage on the storage element. The Boost converter allows extraction of power from transducer 16 when the open circuit voltage developed across transducer 16 is lower than the voltage on storage element 38. The Buck converter allows efficient extraction of power from transducer 16 when the open circuit voltage developed across transducer 16 is higher than the voltage on storage element 38.

The control methods or processes can include a shut down mode of operation such that when the magnitude of the voltage across transducer 16 is below a certain limit, MOSFETs 40, 42 and portions of the supporting electronics are turned off to prevent unnecessary dissipation of power from storage element 38. Alternatively, MOSFETs 40, 42 can be shut down when the duty cycle required by the control method is above or below a certain threshold.

Figure 9:
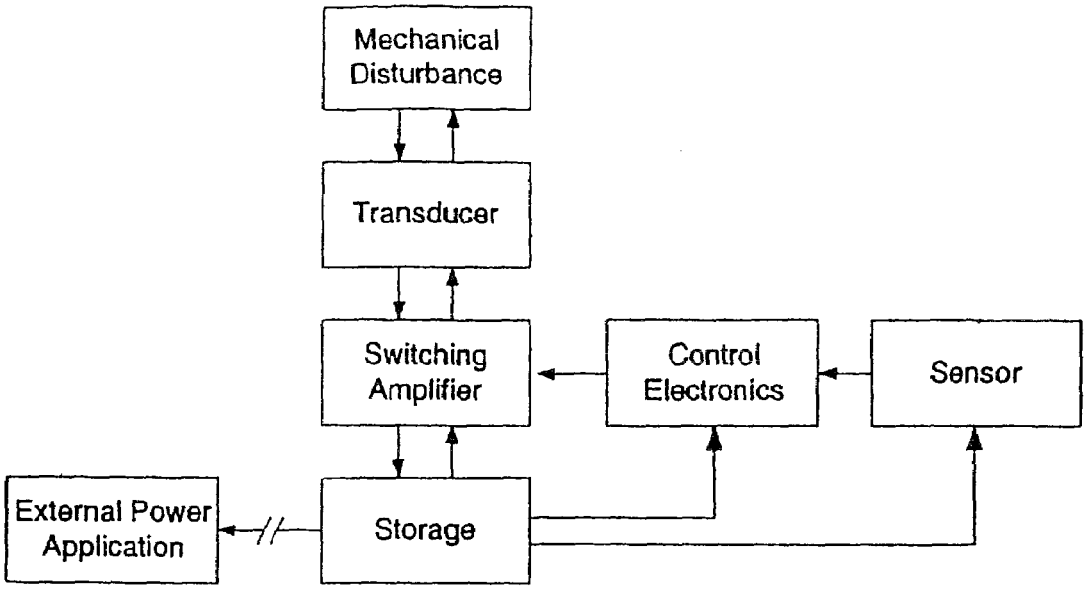
FIG. 9 is a block diagram of the power extraction system of FIG. 5B.

FIG. 9 shows the flow of power between the disturbance and the storage element, and the flow of information. The power from the mechanical disturbance is transferred to the transducer which converts the mechanical power to electrical power. The power from the transducer is transferred to the storage element through the switching amplifier. Power can also flow from the storage element to the transducer through the switching amplifier. The transducer can then convert any received electrical power to mechanical power which in turn acts upon a structure, e.g., the body 4 of the ski 2 of the present invention (FIG. 10) that creates the disturbance. The net power flows to the storage element.

The power for the sensor and control electronics as well as the cyclic peak power needed by the transducer is supplied by the energy accumulated in the storage element, which has been extracted from the disturbance. Energy accumulated in the storage element can also or alternatively be used to power an external application and/or the power extraction circuitry itself.

Losses in the system include losses in energy conversion by the transducer, losses due to voltage drops at diodes 44, 46 and MOSFETs 40, 42, switching losses, and losses due to parasitic resistances or capacitances through the circuit.

The control methods or processes can vary dependent upon whether maximum power generation is desired or self-powering of a transducer acting as a stiffening actuator is desired. When maximum power generation is desired a feedback control loop preferably uses the signal from sensor to direct MOSFETs 40, 42 to apply a voltage to transducer 16 which acts to increase the mechanical work on the transducer 16 contracting and expanding the transducer 16 in phase with the disturbance 36 essentially softening the transducer 16 to the disturbance 36. However, the more energy is extracted from the disturbance 36 the more the vibration of the ski body 4 (FIG. 10) creating the disturbance 36 may be increased.

When the transducer 16 is being used to stiffen a mechanical disturbance 36, a feedback control loop uses the signal from the sensor to adjust the duty cycle of MOSFETs 40, 42 to apply a voltage to transducer 16 which will act to stiffen the oscillation. The system provides self-powered stiffening in that power generated by transducer 16 is used to power transducer 16 for stiffening.

Figure 10:
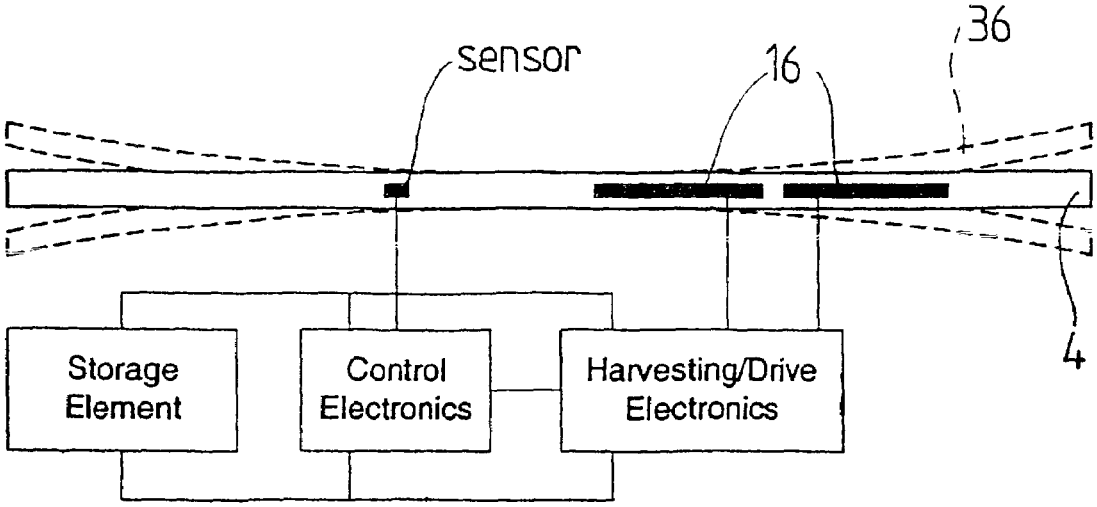
FIG. 10 shows an implementation of the power extraction system of FIG. 5B with a transducer of the system mounted to a structure.

Referring to FIG. 10, one or more transducers 16 can be attached, laminated to one or more locations on the ski body 4, and connected to one harvesting/drive circuit (or more than one harvesting/drive circuit). Deformation of the body 4 of the ski 2 creates the mechanical disturbance 36 on the transducers 16.

Transducer 16 is, for example, a piezoelectric transducer, an antiferroelectric transducer, an electrostrictive transducer, a piezomagnetic transducer, a magnetostrictive transducer, or a magnetic shape memory transducer. Examples of piezoelectric transducers include polycrystaline ceramics such as PZT 5H, PZT 4, PZT 8, PMN-PT, fine grain PZT, and PLZT; polymers such as electrostrictive and ferroelectric polymers, for example, PVDF and PVDF-TFE; single crystal ferroelectric materials such as PZN-PT, PMN-PT, NaBiTi—BaTi, and BaTi; and composites of these materials such as active fiber composites and particulate composites, generally with 1-3, 3-3, 0-3 or 2-2 connectivity patterns.

Possible mechanical configurations of transducer 16 include a disk or sheet in through thickness (33) mode, in transverse (31) or planar (p) mode, or shear (15) mode, single or multilayer, bimorph, monomorph, stack configuration in through thickness (33) mode, rod or fiber poled transverse or along fiber, ring, cylinder or tube poled radially, circumferentially or axially, spheres poled radially, rolls, laminated for magnetic systems. Transducer 16 can be integrated into a mechanical device which transforms forces/pressures and deformation external to the device into appropriate, advantageous forces/pressures and deformation on transducer 16.

Disturbance 36 can be an applied force, an applied displacement, or a combination thereof. For a disturbance applied to transducer 16 in the 33 direction, if the system is designed specifying the stress amplitude on transducer 16, the material from which transducer 16 is formed should be selected which maximizes $k_{gen}^2 s_{gen}^E$, for example, $k_{33}^2 S_{33}^E$. If the system is designed specifying the strain on transducer 16, a material should be selected which maximizes $k_{gen}^2/s_{gen}^D$, for example, $k_{33}^2/s_{33}^D$. Where $k_{gen}$ is the effective material coupling coefficient for the particular generalized disturbance on transducer 16, $s_{gen}^E$ is the effective compliance relating the generalized disturbance or displacement of the transducer in the short circuit condition, and $s_{gen}^D$ is the effective compliance relating the generalized disturbance or displacement of the transducer in an open circuit condition.

Figure 11:
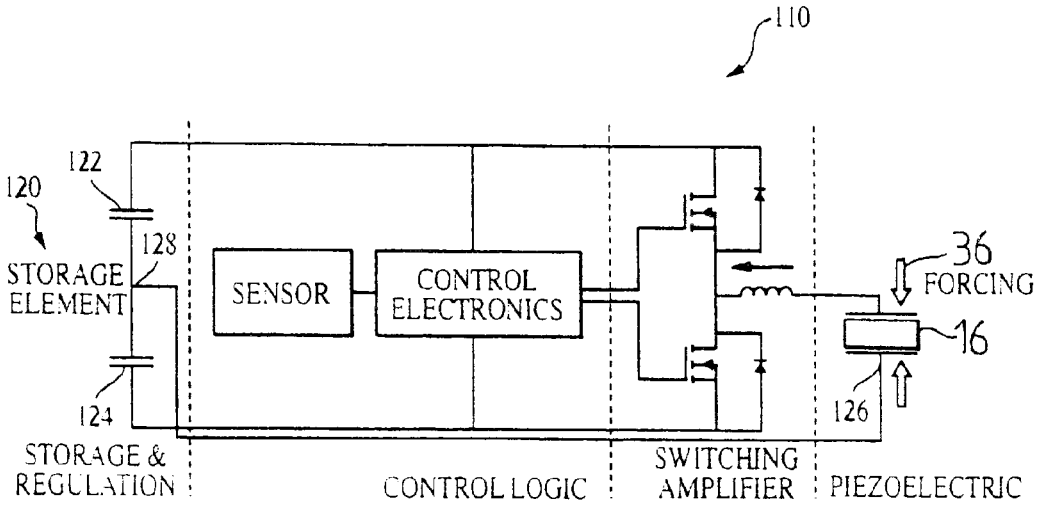
FIG. 11 is a circuit diagram of an alternative embodiment of a power extraction system.

Referring to FIG. 11, in another preferred embodiment, a circuit 110 for extracting power from transducer 16 includes a storage element 120 which includes two storage components 122, 124 connected in series. One side 126 of transducer 16 is connected to a middle node 128 of components 122, 124. This connection biases transducer 16, permitting operation of circuit 110 when the voltage on transducer 16 is positive or negative.

Figure 12:
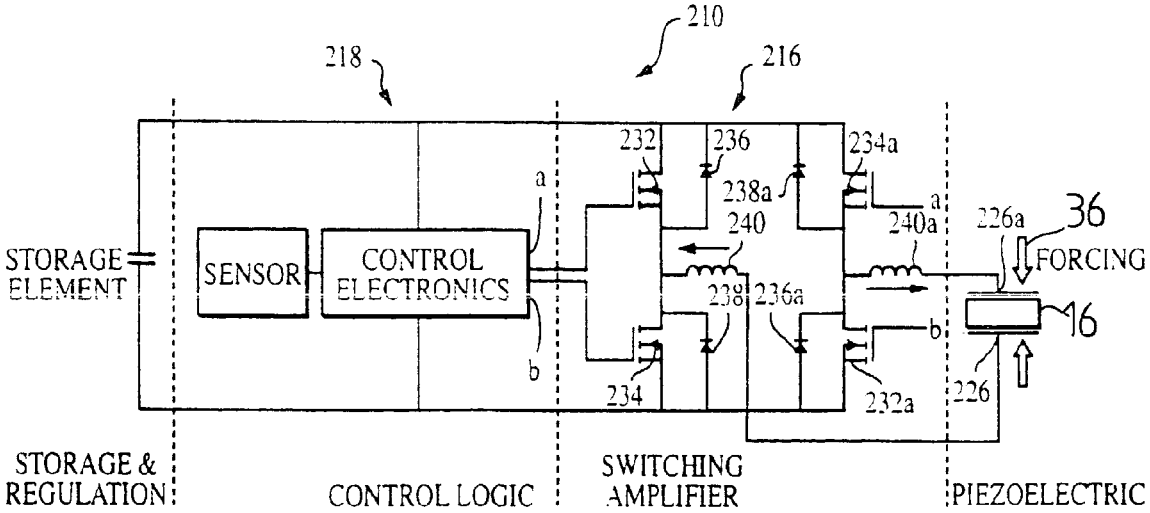
FIG. 12 is a circuit diagram of an additional alternative embodiment of a power extraction system.

Referring to FIG. 12, a circuit 210 includes an H-bridge switching amplifier 216. In a first approach, control logic 218 operates MOSFETs 232, 232*a* together, and MOSFETs 234, 234*a* together:

Phase I: MOSFETs 232, 232*a* are off, MOSFETs 234, 234*a* are turned on, current flows through MOSFETs 234, 234*a*, and energy from transducer 16 is stored in inductors 240, 240*a*.

Phase II: MOSFETs 234, 234*a* are turned off and MOSFETs 232, 232*a* are switched on, current flows through diodes 236, 236*a*, and the energy stored in inductors 240, 240*a* is transferred to storage element 38.

Phase III: As the current becomes negative, the current stops flowing through diodes 236, 236*a* and flows through MOSFETs 232, 232*a*, and energy from storage element 38 is transferred to inductors 240, 240*a*.

Phase IV: MOSFETs 232, 232*a* are turned off, current flowing through diodes 238, 238*a* increases, and the energy stored in inductors 240, 240*a* is transferred to transducer 16.

In a second operational approach, only half of the H-bridge is operated at any given time, depending upon the polarity of the voltage desired on transducer 16. When a positive voltage is desired, MOSFET 234*a* is turned off and MOSFET 232*a* is tuned on, grounding side 226*a* of transducer 16. MOSFETs 232 and 234 are then turned on and off as described above with reference to FIG. 6, to affect the voltage on side 226 of transducer 16. When a negative voltage on transducer 16 is desired, MOSFET 232 is turned off and MOSFET 234 is turned on, grounding side 226 of transducer 16. MOSFETs 232*a* and 234*a* are then turned on and off as described above with reference to FIG. 4, to affect the voltage on side 226*a* of transducer 16.

Referring to FIG. 13, the circuit of FIG. 12 has been modified by including an independent power source, for example, a battery 250, which powers the sensor and control electronics. The storage element still stores power to be transferred to and received from transducer 16.

Referring to FIG. 14A, a simplified, resonant power extracting circuit 300 can be employed in place of amplifier electronics for extracting power from transducer 16. Circuit 300 includes a resonant circuit 302, a rectifier 304, control logic 306, and a storage element, for example, a rechargeable battery or capacitor. Resonant circuit 302 includes elements such as capacitors and inductors which when coupled to the transducer produce electrical resonances in the system. Resonant circuit 302 provides for flow of electrical power from and to transducer 16. The sensor and control electronics 308 can be used to adapt the voltage level of the storage element using, for example, a shunt regulator, or tune the resonant circuit by switching on different inductors or capacitors within a bank of components with different values.

For example, referring to FIG. 14B, a piezoelectric transducer 16 is connected to a resonant circuit 302 formed by an inductor 312. Resonant circuit 302 is effective in a narrow frequency band dependent upon the value of inductor 312. The value of inductor 312 is selected such that the resonant frequency of the capacitance of transducer 16 and the inductance of inductor 312 is tuned to or near the dominant frequency, frequencies or range of frequencies of disturbance 36 or the resonance of the mechanical system. Rectifier 304 is a voltage doubling rectifier including diodes 314, 316. Power extracted from transducer 16 is stored in storage elements 318, 320.

For a magnetostrictive transducer 16, the resonant circuit 302 can include a capacitor connected in parallel with transducer 16.

The amplitude of the voltage across inductor 312 grows as a result of resonance until the voltage is large enough to forward bias one of diodes 314, 316. This occurs when the voltage across inductor 312 is greater than the voltage across one of storage elements 318, 320.

In the case of a sinusoidal disturbance, as may be provided in a ski 2 during skiing, the current flow through circuit 310 can be described in four phases:

Phase I: As the transducer voltage increases from zero, no current flows through diodes 314, 316 while the transducer voltage is less than the voltage on storage elements 318, 320.

Phase II: When the transducer voltage grows larger than the voltage on storage element 318, diode 314 becomes forward biased, and current flows through diode 314 into storage element 318.

Phase III: As the transducer voltage drops, diodes 314, 316 are reverse-biased and again no current flows through the diodes.

Phase IV: When the transducer voltage goes negative and has a magnitude greater than the voltage on storage element 320, diode 316 becomes forward biased, and current flows through diode 316 into storage element 320. As the transducer voltage begins to increase, diodes 314, 316 are reverse-biased again and phase 1 repeats.

Referring to FIGS. 15A to 15G, an example of the power extracted from transducer 16 in circuit 310 is graphically represented where the open circuit amplitude of the voltage across transducer 16 would have been 10 volts. The same transducer and disturbance described above with reference to FIGS. 7A to 7G are used in this example. A 168H inductor is used in this example such that the time constant of the inductor and transducer corresponds to 100 Hz.

Figure 15A:
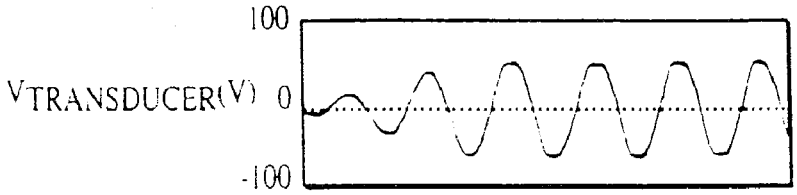
FIGS. 15A–15G are various voltage, current, power, and energy waveform diagrams of the circuit of FIG. 14B.

FIG. 15A shows the voltage across transducer 16 of FIG. 14 as a function of time. The peak amplitude of the voltage grows as a result of resonance until it is greater than the voltage on storage elements 318, 320. This voltage is greater than twice any peak voltage of the open circuit voltage of transducer 16 due to disturbance 36 alone (see FIG. 8A). Here, the peak amplitude of the voltage is about 60 volts. (The circuit can act in pure transient scenarios although transient to steady state is shown.)

Figure 15B:
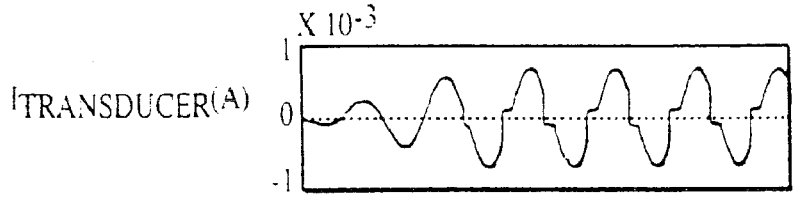
Figure 15C:
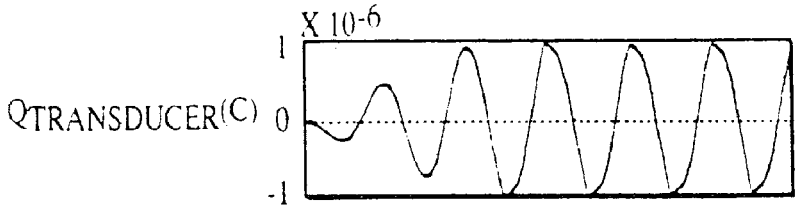

FIG. 15B shows the current waveform on transducer 16 and FIG. 15C the charge waveform on transducer 16. Due to the resonance of the circuit, the peak of the integral of the current onto and off transducer 16 is greater than two times higher than any peak of an integral of a current of a short circuit transducer due to the disturbance alone (see FIGS. 8B and 8C).

Figure 15D:
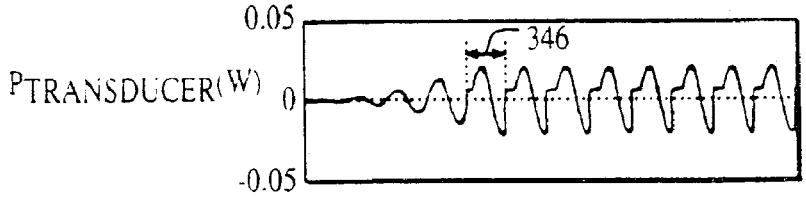

Due to the phasing of the voltage and current waveforms, the power flow to and from transducer 16, FIG. 15D, alternates between peaks of about 0.02 and −0.02 Watts. Thus, power flows to transducer 16 from resonator circuit 312 and from transducer 16 to resonator circuit 312 during the course of disturbance 36 on transducer 16, for example, during a single sinusoidal cycle 346, with the net power flowing from transducer 16 to storage element 318, 320. The cycle need not be sinusoidal, for example, where the disturbance has multiple frequency harmonics or broad frequency content such as in a square wave, a triangular wave, a saw tooth wave, and broadband noise.

Figure 15E:
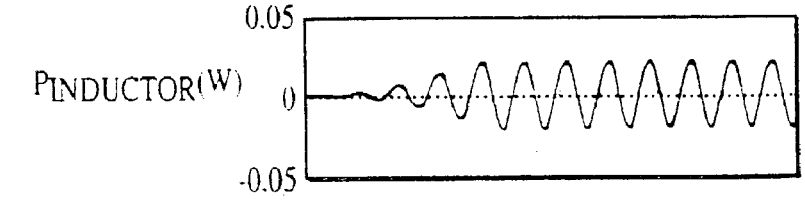

The power into inductor 312 is shown in FIG. 15E. Where the waveform is positive, power is being stored in inductor 312, and where the waveform is negative, power is being discharged from inductor 312.

Figure 15F:
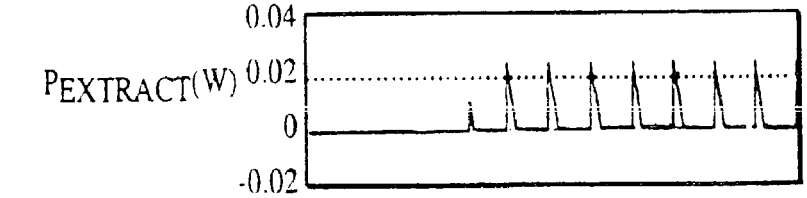
Figure 15G:
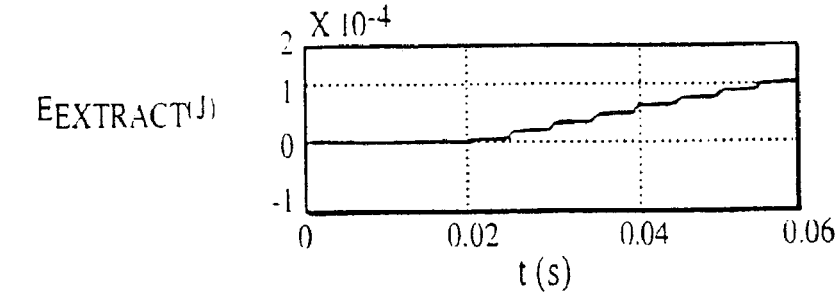

The extracted power and energy are shown in FIGS. 15F and 15G. Over a period of 0.06 seconds, approximately $1.0\times10^{-4}$ Joules of energy are extracted.

The voltage across storage elements 318, 320 is tuned to optimize the efficiency of the power extraction. For example, voltage across storage elements 318, 320 is optimally about half the peak steady state voltage across the transducer if no rectifier were coupled to the transducer and the transducer and inductor connected in parallel were resonating under the same disturbance. An adaptive system uses a sensor to adapt to changing system frequencies, damping, stiffness or behavior to adapt the resonator or adapt the storage element voltage level.

Figure 16:
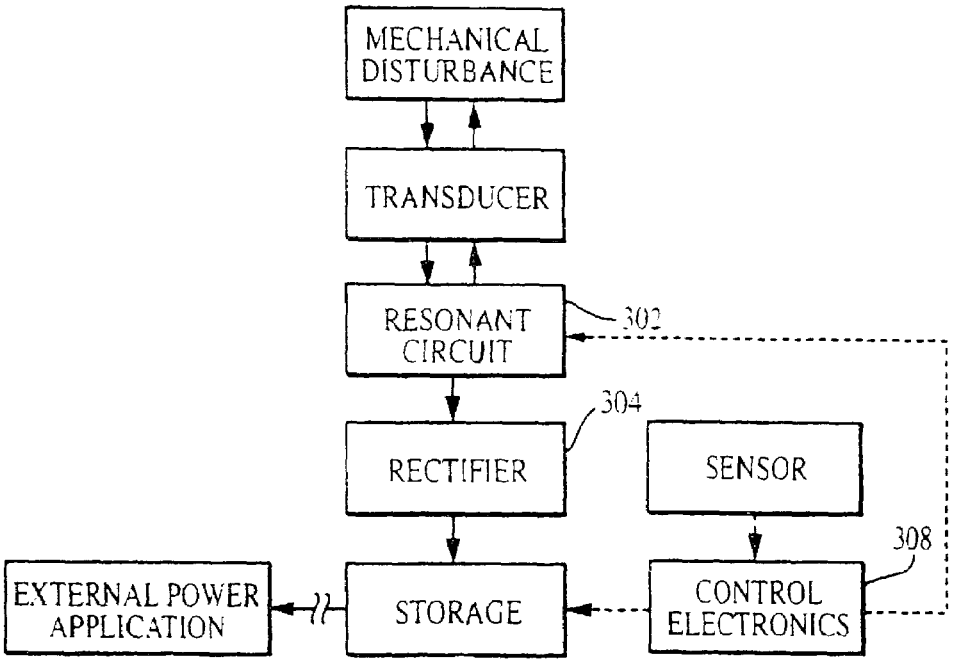
FIG. 16 is a block diagram of the power extraction system of FIG. 14B.

FIG. 16 shows the flow of power between disturbance and storage element, and the flow of information (dashed lines). The power from mechanical disturbance is transferred to transducer which converts the mechanical power to electrical power. The power from transducer is transferred to storage element through resonant circuit 302 and rectifier 304. Power can also flow from resonant circuit 302 to transducer. Transducer can then convert any received electrical power to mechanical power which in turn acts upon mechanical disturbance, i.e. the ski body 4.

The power for sensor and control electronics 308 is supplied by the energy accumulated in storage element, which has been extracted from disturbance. The cyclic peak power needed by transducer is supplied by resonant circuit 302. Energy accumulated in storage element can also or alternatively be used to power an external application or the power extraction circuitry itself for vibration suppression.

Rather than employ a storage element, extracted power can be used directly to power external application.

Figure 17:
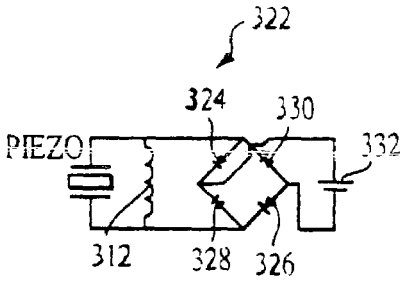
FIG. 17 is a circuit diagram of an alternative embodiment of a resonant rectifier power extraction system.

An alternative resonant circuit 322 is shown in FIG. 17. Circuit 322 includes an inductor 312 and four diodes 324, 326, 328 and 330 connected as a full wave bridge. Power extracted from transducer 16 is stored in storage element 332.

The current flow through circuit 322 can be described in four phases:

Phase I: As the transducer voltage increases from zero, no current flows through diodes 324, 326, 328 and 330 while the transducer voltage is less than the voltage on storage element 332.

Phase II: When the transducer voltage grows larger than the voltage on storage element 332, diodes 324, 326 become forward biased, and current flows through diodes 324, 326 and into storage element 332.

Phase III: As the transducer voltage drops, all diodes are reverse-biased and the system operates as an open circuit.

Phase IV: When the transducer voltage goes negative and has a magnitude greater than the voltage on storage element 332, diodes 328 and 330 become forward biased, and current flows through diodes 328 and 330 into storage element 332. As the transducer voltage begins to increase, all diodes again become reverse biased and phase 1 repeats.

Figure 18:
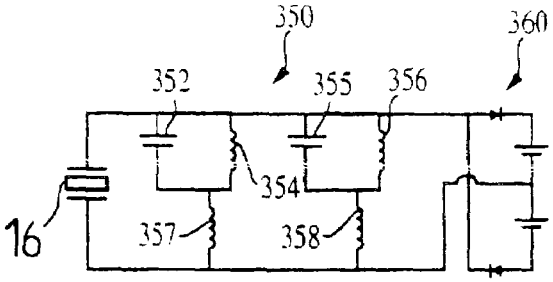
FIG. 18 is a circuit diagram of an additional alternative embodiment of a resonant rectifier power extraction system.

Referring to FIG. 18, a more sophisticated resonant circuit 350 includes two capacitor and inductor pairs 352, 354 and 355, 356, respectively, and two resonance inductors 357, 358. Each capacitor, inductor pair is tuned to a different frequency of interest. Thus, circuit 350 has multiple resonances which can be tuned to or near multiple disturbance frequencies or multiple resonances of the mechanical system. Additional capacitors and inductors may be incorporated to increase the number of resonances in circuit 350. Broadband behavior can be attained by placing a resistance in series or parallel with the inductors. FIG. 18 shows resonant circuit 350 connected to a voltage doubling rectifier 360, which operates as in FIG. 14B.

The different resonant circuits of FIGS. 14B and 18 can be attached to different rectifier circuits, such as a full bridge rectifier or an N-stage parallel-fed rectifier.

A passive voltage doubling rectifier circuit 410 for extracting energy from transducer 16 is shown in FIG. 19. Circuit 410 includes diodes 414, 416. Power extracted from transducer 16 is stored in storage elements 418, 420.

The current flow through circuit 410 can be described in four phases:

Phase I: As the transducer voltage increases from zero, no current flows through diodes 414, 416 while the transducer voltage is less than the voltage on storage element 418.

Phase II: When the transducer voltage grows larger than the voltage on storage element 418, diode 414 becomes forward biased, and current flows through diode 414 into storage element 418.

Phase III: As the transducer voltage drops, diodes 414, 416 are reverse-biased and the circuit operates as an open circuit.

Phase IV: When the transducer voltage 4 goes negative and has a magnitude greater than the voltage on storage element 420, diode 416 becomes forward biased, and current flows through diode 416 into storage element 420. As the transducer voltage begins to increase, diodes 414, 416 are reverse-biased and phase 1 repeats.

Referring to FIGS. 20A to 20F, an example of the power extracted from transducer 16 in circuit 410 is graphically represented where the open circuit amplitude of the voltage across transducer 16 would have been 10 volts: FIG. 20A shows the voltage across transducer 16 as a function of time. The peak amplitude of the voltage is about 5 volts. FIG. 20B shows the current waveform on transducer 16, and FIG. 20C the charge waveform.

The power to and from transducer 16, FIG. 20D, has a peak value of about $5\times10^{-4}$ Watts. The extracted power and energy are shown in FIGS. 20E and 20F. Over a period of 0.06 seconds, approximately $0.75\times10^{-5}$ Joules of energy are extracted.

The voltage across storage elements 418, 420 is tuned to optimize power extraction. The voltage across storage elements 418, 420 is optimally about half the voltage which would appear across an open circuit transducer undergoing the same mechanical disturbance.

Figure 21:
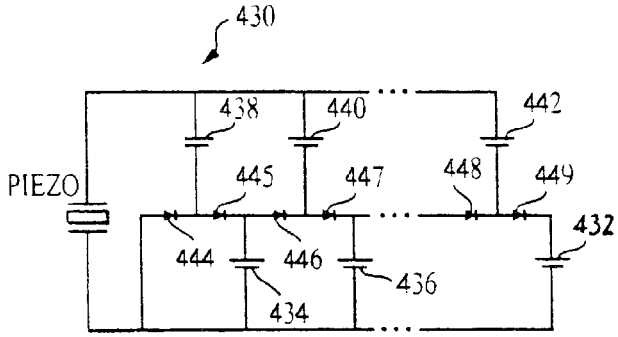
FIG. 21 is a circuit diagram of an alternative embodiment of a passive rectifier power extraction system.

Referring to FIG. 21, in a passive, N-stage parallel fed voltage rectifier 430 the voltage of storage element 432 is N times the amplitude of the voltage of disturbance 36. Capacitors 434, 436 act as energy storage elements with the voltage in each stage being higher than the voltage in the previous stage. Capacitors 438, 440 and 442 act as pumps transferring charge from each stage to the next, through diodes 444–449. A resonant circuit as described above can be incorporated into rectifier 430.

Figure 22A:
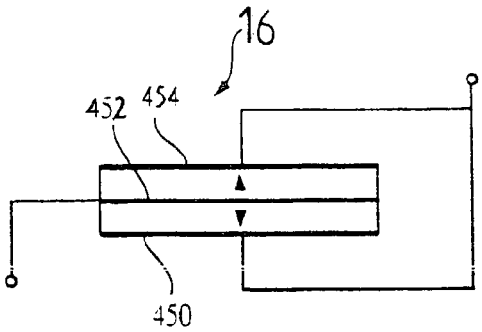
FIGS. 22A–22B illustrate partitioning of a transducer.
Figure 22B:
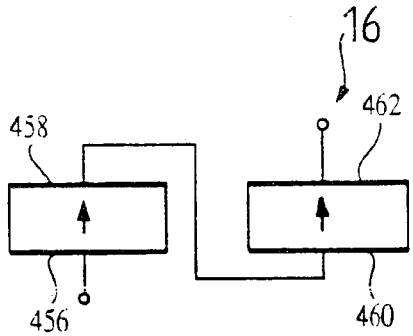

A transducer may be partitioned, and different electrode or coil configurations, that is, the electrical connections to transducer 16, may be used to optimize electric characteristics. Such configurations are shown for piezoelectric transducers in FIGS. 22A and 22B where for the same volume of material and the same external disturbance, different electrode configurations provide tradeoffs between the voltage and current output of transducer 16. For example, in FIG. 22A transducer 16 is segmented longitudinally and connected electrically in parallel with electrodes 450, 452, and 454, providing for higher current and lower voltage. In FIG. 22B, the transducer area is segmented and connected electrically in series with electrodes 456, 458, 460, and 462, providing for higher voltage and lower current.

Figure 23:
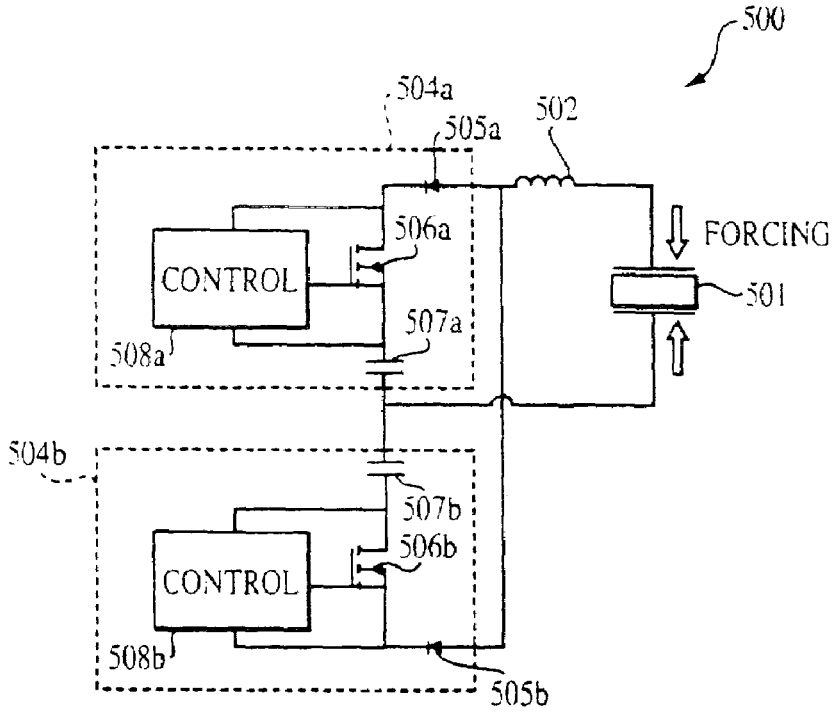
FIG. 23 is a circuit diagram of an alternative embodiment of a power extraction system.

Referring to FIG. 23, a circuit 500 for extracting electrical power-from a transducer 501 includes an inductor 502, and two symmetric sub-circuits 504*a*, 504*b*. Each sub-circuit 504*a*, 504*b* has a diode 505*a*, 505*b*, a switching element 506*a*, 506*b*, a storage element 507*a*, 507*b*, and control circuitry 508*a*, 508*b*, respectively. The switching element 506*a*, 506*b*, is, for example, a MOSFET, bipolar transistor, IGBT, or SCR. The storage element 507*a*, 507*b* is, for example, a capacitor, a rechargeable battery or combination thereof.

Circuit 500 is preferably used to stiffen the torsional oscillation of the board for performing skiing sports to which transducer 501 is coupled.

Figure 24A:
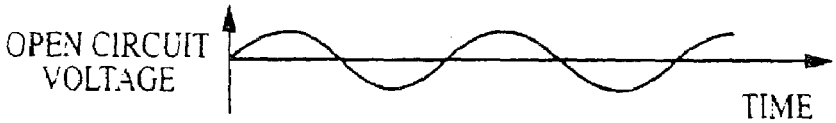
FIGS. 24A–24C are voltage and current versus time graphs.
Figure 24B:
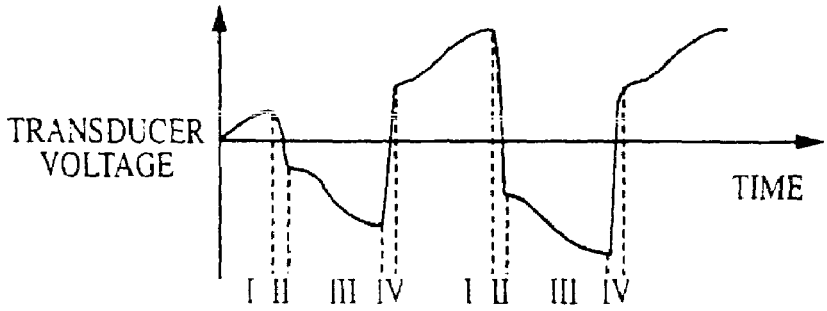
Figure 24C:
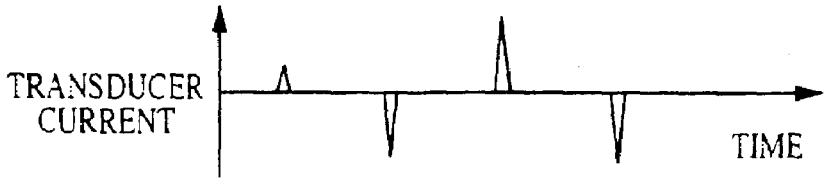

The operation of circuit 500 is described with reference to FIGS. 24A to 24C. For reference, FIG. 24A shows the voltage on transducer 501 as a result of an oscillating external disturbance, in the absence of circuit 500. The operation of circuit 500 can be divided into four phases. FIGS. 24B and 24C are graphical representations of the four phases, FIG. 24B showing the voltage across transducer 501 as a function of time, and FIG. 24C showing the current through transducer 501 as a function of time.

Phase I: As the voltage on transducer 501 increases in response to the oscillatory disturbance, switches 506*a* and 506*b* are both in the off position, and no current flows through the switches.

Phase II: After the voltage on transducer 501 peaks, control circuit 508*a* turns on switch 506*a*. Current from transducer 501 flows via the inductor 502, the diode 505*a*, and the switch 506*a* to the energy storage element 507*a*.

Phase IIa: While switch 506*a* is on, the amplitude of the current from transducer 501 increases, storing energy in inductor 502 and storage element 507*a*. In the process, the voltage across transducer 501 decreases and the voltage across storage element 507*a* increases. Current continues to increase from transducer 501 until the voltage across inductor 502 reaches zero.

Phase IIb: As the current from transducer 501 begins to decrease, the energy stored in inductor 502 is released, forcing the voltage across transducer 501 to drop below zero. This continues until the energy in inductor 502 is depleted, at which point the voltage across transducer 501 approaches the negative of the value it had prior to the beginning of phase II.

Phase III: With both switches 506*a*, 506*b* off for the next half cycle, the voltage on transducer 501 continues to decrease in response to the oscillatory disturbance.

Phase IV: After the voltage on transducer 501 reaches a minimum, the symmetric portion 504*b* of the circuit is activated. The control circuit 508*b* turns on switch 506*b*. Current from transducer 501 flows via the inductor 502, the diode 505*b*, and the switch 506*b* to the energy storage element 507*b*.

Phase IVa: While the switch is on, the amplitude of the current from transducer 501 increases, storing energy in inductor 502 and storage element 507*b*. In the process, the voltage across transducer 501 decreases and the voltage across storage element 507*b* increases. Current from transducer 501 continues to increase until the voltage across inductor 502 reaches zero.

Phase IVb: As the current from transducer 501 begins to decrease, the energy stored in inductor 502 is released, forcing the voltage across transducer 501 to drop below zero. This continues until the energy in inductor 502 is depleted, at which point the voltage across transducer 501 approaches the negative of the value it had prior to the beginning of phase IV.

As the four phases repeat, the magnitude of the voltage across transducer 501 increases. The voltage can be many times higher than the voltage which would have been measured across transducer 501 in the absence of circuit 500. As a result, more energy is extracted from transducer 501 during phases II and IV.

In order to stiffen the ski, preferably the circuit 500 as shown in FIG. 23 is connected with the transducer 501. The circuit 500 comprises two energy storage elements 507*a* and 507*b* which are provided for storing energy extracted from the transducer during skiing. As soon as the ski undergoes oscillation, the transducer transduces the mechanical disturbance applied thereto into a voltage signal. During phases II and IV, this voltage signal is used to store electrical energy in the energy storage elements 507*a* and 507*b*, respectively. This stored electrical energy is then used during phases III and I (see FIG. 24B) to actively stiffen the ski 2 in that the electrical energy is supplied back to the transducer. The timing of the switches 506*a* and 506*b* is controlled such that the voltage thus supplied to the transducer causes the transducer to transduce it into mechanical energy which acts against the oscillatory movement of the ski and hence actively stiffens the ski against the oscillation. It is apparent from a comparison of FIGS. 24A and 24B that the voltage applied to the transducer by circuit 500 between two subsequent peaks of vibration (i.e., the maxima of the curve of FIG. 24A) does not change its polarity. Hence, the applied voltage applies a force on the ski 2 that acts against the direction of the movement of the oscillation from one peak to the next peak (e.g. phase III). Subsequently, the circuit forces the voltage across the transducer to change polarity. The opposite voltage is applied to the transducer during back-movement of the oscillation of the ski 2 (phase I) thus applying a force that again acts against the movement of the ski and stiffens the oscillation of the ski 2.

Figure 25:
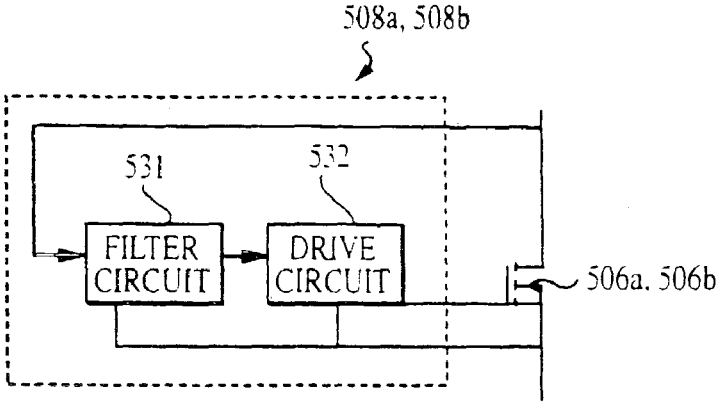
FIG. 25 is a block diagram of a control circuit of the power extraction system of FIG. 23.

Referring to FIG. 25, the control circuitry 508*a*, 508*b* includes a filter circuit 531 for processing the voltage across switch 506*a*, 506*b*, respectively, and a switch drive circuit 532. In this embodiment, the control circuit is powered from an external voltage source, not shown, such as a battery or power supply. The filter circuit 531 differentiates the signal and turns the switch on when the voltage across the switch begins to decrease. In addition, filter circuit 531 can include components for noise rejection and for turning the switch on if the voltage across the switch becomes greater than a pre-specified threshold. Filter circuit 531 can also include resonant elements for responding to specific modes of the disturbance.

Figure 26:
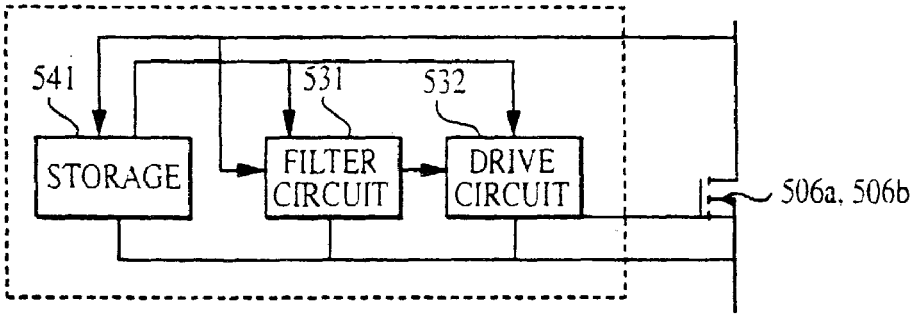
FIG. 26 is a block diagram of a self-powered control circuit.

Referring to FIG. 26, in an alternative embodiment, the control circuit includes a storage element 541 which is charged by current from transducer 501. Storage element 541 is then used to power filter circuit 531 and switch drive circuit 532. This embodiment is self-powered in the sense that there is no need for an external power supply.

Figure 27:
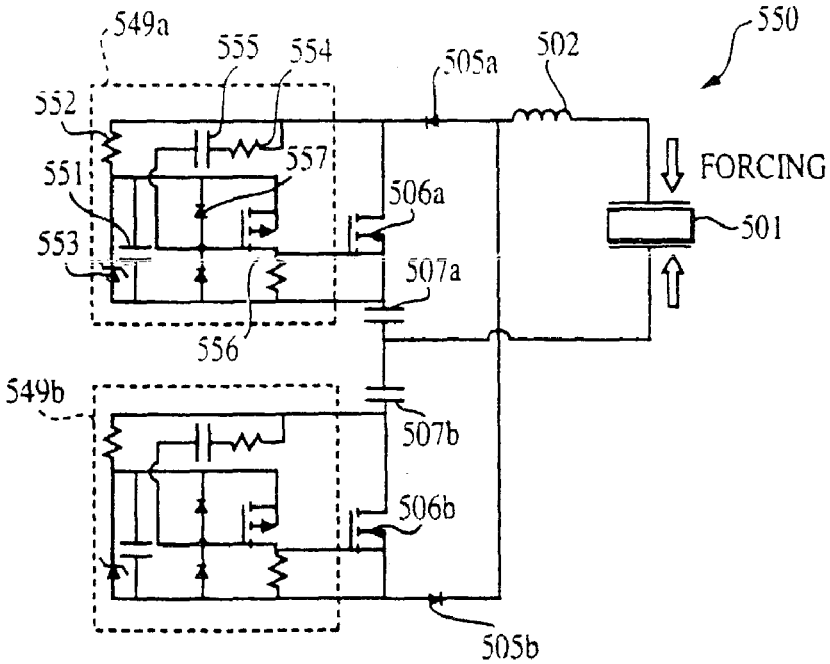
FIG. 27 is a circuit diagram of a power extraction system employing a self-powered control circuit.

Referring to FIG. 27, a self-powered circuit 550 for extracting electrical power from transducer 501 requires no external power for operating control circuits 549*a*, 549*b* and transducer 501. A capacitor 551, which is charged up through a resistor 552 and/or through resistor 554, capacitor 555 and diode 557 during phase I of the circuits operation (i.e. while the voltage across the transducer is increasing), acts as the storage element 541. A Zener diode 553 prevents the voltage of capacitor 551 from exceeding desired limits. When the voltage across transducer 501 begins to decrease, a filter (resistor 554 and capacitor 555) turns on a p-channel MOSFET 556. MOSFET 556 then turns on switch 506*a*, using the energy stored in capacitor 551 to power the gate of MOSFET 556. In the process, capacitor 551 is discharged, causing switch 506*a* to turn off after a desired interval. The same process is then repeated in the second half of the circuit.

Figure 28:
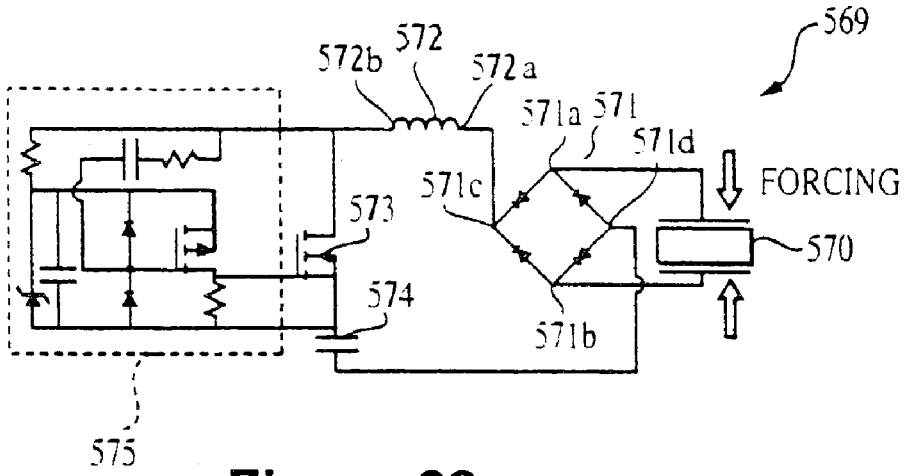
FIG. 28 is a circuit diagram of an alternative embodiment of a power extraction system.

Referring to FIG. 28, a circuit 569 for extracting electrical power from a transducer 570 includes a rectifier 571, an inductor 572, a switching element 573, a storage element 574, and control circuitry 575. The switching element 573 is, for example, a MOSFET, bipolar transistor, IGBT, or SCR. The storage element 574 is, for example, a capacitor, a rechargeable battery or combination thereof. The control circuit 575 corresponds to self-powered control circuitry 549*a* described above with reference to FIG. 27. Rectifier 571 has first and second input terminals 571*a*, 571*b*, and first and second output terminals 571*c*, 571*d*. First and second input terminals 571*a*, 571*b* are connected across first and second terminals 570*a*, 570*b* of transducer 570. Inductor 572 includes first and second terminals 572*a*, 572*b*. First terminal 572*a* of inductor 572 is connected to first output terminal 571*c* of rectifier 571. Switching element 573 is connected to second terminal 572*b* of inductor 572 and second output terminal 571*d* of rectifier 571.

Figure 29:
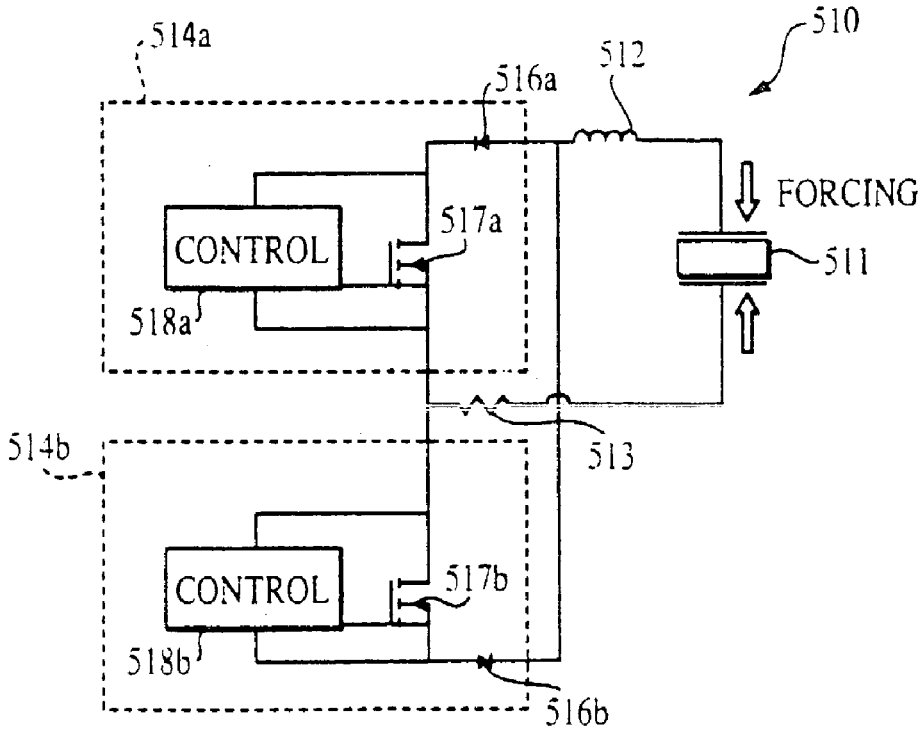
FIG. 29 is a circuit diagram of a power damping system.

Referring to FIG. 29, a circuit 510 for stiffening oscillation of a ski to which a transducer 511 is attached includes an energy dissipation component 513, such as a resistor, in the circuit. Circuit 10 also includes an inductor 512 and two symmetric sub-circuits 514*a*, 514*b*. Each sub-circuit 514*a*, 514*b* includes a diode 516*a*, 516*b*, a switching element 517*a*, 517*b*, and control circuitry 518*a*, 518*b*, respectively. The switching element 517*a*, 517*b* is, for example, a MOSFET, bipolar transistor, IGBT, or SCR. The dissipation element 513 can be eliminated if the inherent energy loss in the remaining circuit components provide sufficient energy dissipation.

Figure 30:
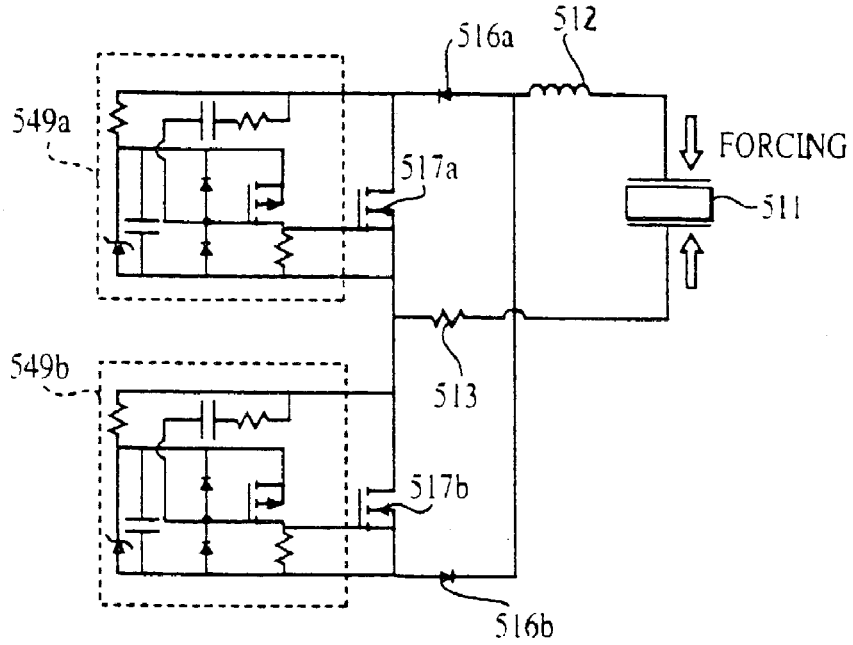
FIG. 30 is a circuit diagram of a self-powered power damping system.

FIG. 30 shows an implementation of the circuit of FIG. 29 incorporating the self-powered control circuitry 549*a*, 549*b* described above with reference to FIG. 28.

Figure 31:
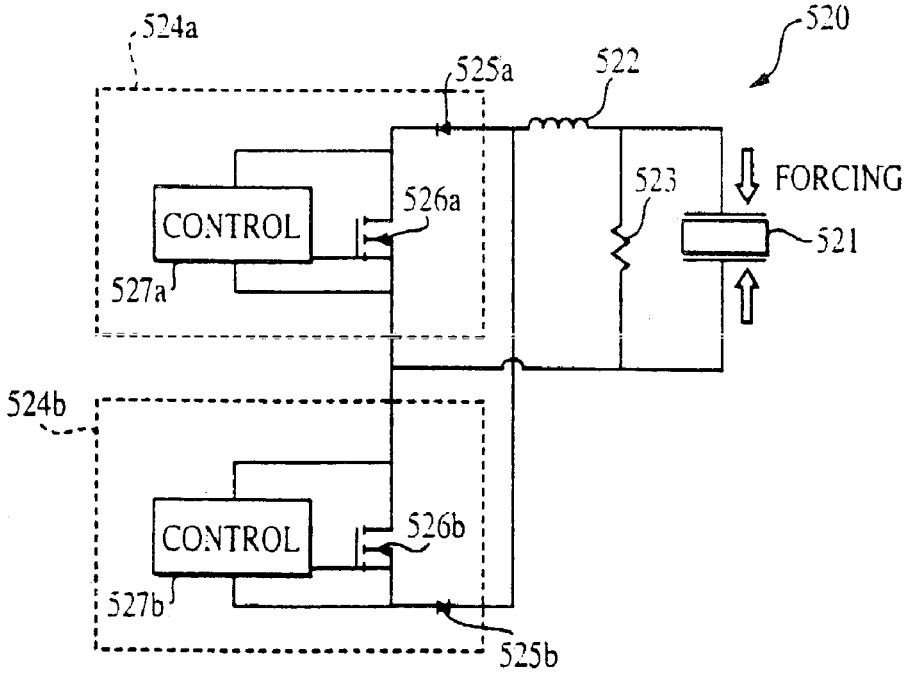
FIG. 31 is a circuit diagram of an alternative embodiment of a power damping system.

Referring to FIG. 31, a circuit 520 for stiffening oscillation, e.g., torsional oscillation, of a ski 2 to which a transducer 521 is attached includes an inductor 522, an energy dissipation component 523, such as a resistor, and two symmetric sub-circuits 524*a*, 524*b*. Each sub-circuit 524*a*, 524*b* includes a diode 525*a*, 525*b*, a switching element 526*a*, 526*b*, and control circuitry 527*a*, 527*b*, respectively. The switching element 516*a*, 526*b* is, for example, a MOSFET, bipolar transistor, IGBT, or SCR. The dissipation component 523 can be eliminated if the inherent energy loss in the remaining circuit components provide sufficient energy dissipation. Control circuitry 527*a*, 527*b* can be as described above with reference to FIG. 30.

The placement of the dissipation component in FIGS. 29 and 31 effects the size of the circuit components selected to provide the desired dissipation. The particular placement depends upon the amplitude and frequency of the vibrations of the mechanical disturbance and the capacitance of the transducer.

Figure 32:
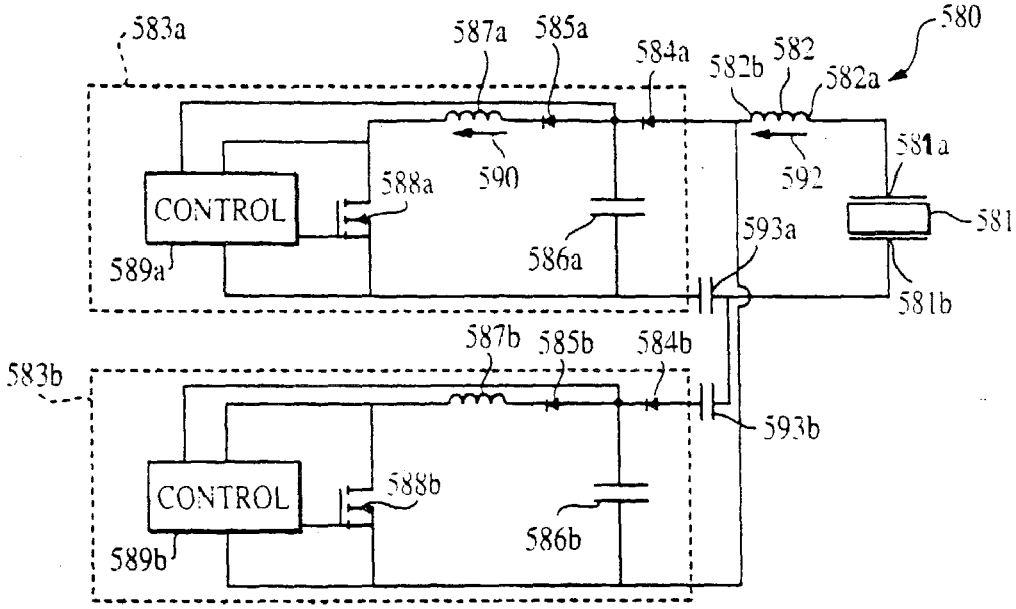
FIG. 32 is a circuit diagram of an additional alternative embodiment of a power extraction system.

Referring to FIG. 32, a circuit 580 for extracting electrical power from a transducer 581 includes an inductor 582 and two symmetric subcircuits 583*a*, 583*b*. Each subcircuit 583*a*, 583*b* includes a pair of diodes 584*a* and 585*a*, 584*b* and 585*b*, a capacitor 586*a*, 586*b*, an inductor 587*a*, 587*b*, a switching element 588*a*, 588*b*, control circuitry 589*a*, 589*b*, and storage element 593*a*, 593*b*, respectively. The switching element 588*a*, 588*b* is, for example, a MOSFET, bipolar transistor, IGBT, or SCR. Inductor 582 has a first terminal 582*a* connected to a first terminal 581*a* of transducer 581, and a second terminal 582*b* connected to subcircuit 583*a*. Subcircuit 583*a* is also connected to a second terminal 581*b* of transducer 581. Subcircuit 583*b* is also connected to second terminal 582*b* of inductor 582 and second terminal 581*b* of transducer 581. The storage elements 593*a*, 593*b* have relatively large capacitance values and therefore their voltage is small relative to the transducer voltage or the voltage across capacitors 586*a*, 586*b*. Diodes 584*a*, 584*b*, 585*a*, 585*b* ensure that power flows into storage elements 593*a*, 593*b*.

Circuit 580 can also be used to stiffen an oscillation of a ski 2 to which transducer 531 is coupled. For this purpose, the storage elements 593*a*, 593*b* can be replaced by dissipation components, for example, resistors, as in FIG. 27. Alternatively, a dissipation component can be connected in parallel with transducer 581, as in FIG. 31. The dissipation component can be eliminated if the inherent energy loss in the remaining circuit components provide sufficient energy dissipation.

Figure 33A:
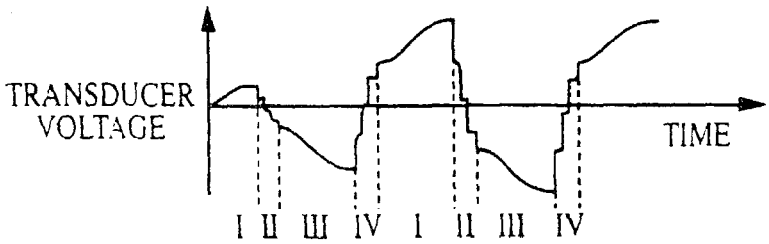
FIGS. 33A–33C are voltage versus time graphs.
Figure 33B:
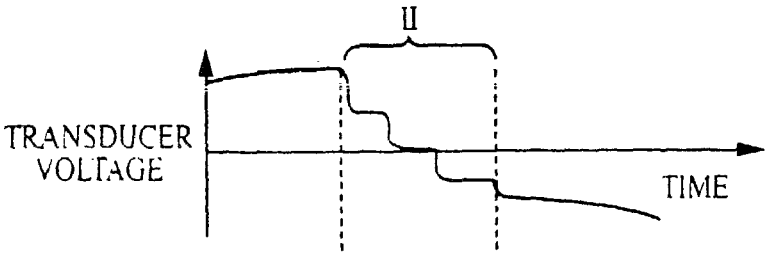
Figure 33C:
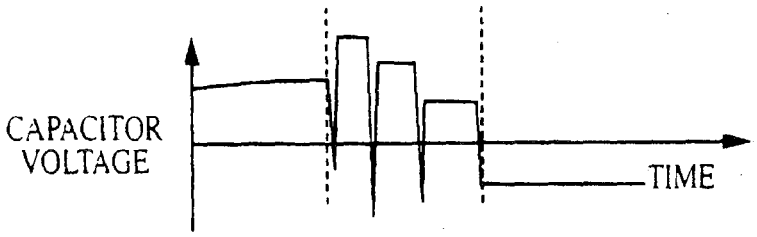

The operation of circuit 580 is described with reference to FIGS. 33A to 33C. FIG. 33A shows the voltage across transducer 581 as a function of time and can be compared with the waveform of FIG. 24B. The additional inductors 587*a*, 587*b* and capacitors 586*a*, 586*b* in each subcircuit, in combination with control circuits 589*a*, 589*b*, described further below, cause multiple steps in the voltage during phase II and phase IV. FIGS. 33B and 33C show in more detail the voltage across transducer 581 and across capacitor 586*a* during phase II.

Phase I: As the voltage on transducer 581 increases in response to the oscillatory disturbance, switches 588*a*, 588*b* are both in the off position, and no current flows through the switches. The voltage across capacitor 586*a* is effectively equal to the voltage across transducer 581.

Phase II: After the voltage on transducer 586*a* peaks, control circuit 589*a* turns on switch 588*a*. Current 590 from capacitor 586*a* flows via diode 585*a* and inductor 587*a* through switch 588*a*. Thus the voltage across capacitor 586*a* drops rapidly. As the voltage across capacitor 586*a* drops below the voltage across transducer 581, current 592 begins to flow from transducer 581 through inductor 582 and diode 584*a* to capacitor 586*a*. As current 592 becomes larger than current 590, the voltage across capacitor 586*a* stops decreasing and begins to increase. Switch 588*a* is turned off as soon as the voltage across capacitor 586*a* begins to increase. The current from transducer 581 then causes the voltage across capacitor 586*a* to increase rapidly to a value possibly larger than its value prior to the beginning of phase II. During this process, the voltage across transducer 581 is reduced to a fraction of its value prior to phase II. After a short delay, the control circuit turns on switch 588*a* again, and the process is repeated several times during phase II. Thus the voltage across transducer 581 decreases in a number of steps.

Phase III: With both switches 588*a*, 588*b* off for the next half cycle, the voltage on transducer 581 continues to decrease in response to the oscillatory disturbance. The voltage across capacitor 586*b* is effectively equal to the voltage across transducer 581.

Phase IV: After the voltage on capacitor 586*b* reaches a peak, the process of phase II repeats for subcircuit 583*b*.

As the four phases repeat, the magnitude of the voltage across transducer 581 increases. The multiple switching events that occur during phases II and IV, in effect slow the transition in the transducer voltage that occurs during these phases. As a result, less high frequency noise is caused in the ski to which transducer 581 is coupled in the process of stiffening the low frequency oscillation as compared to the circuit of FIG. 23.

Figure 34:
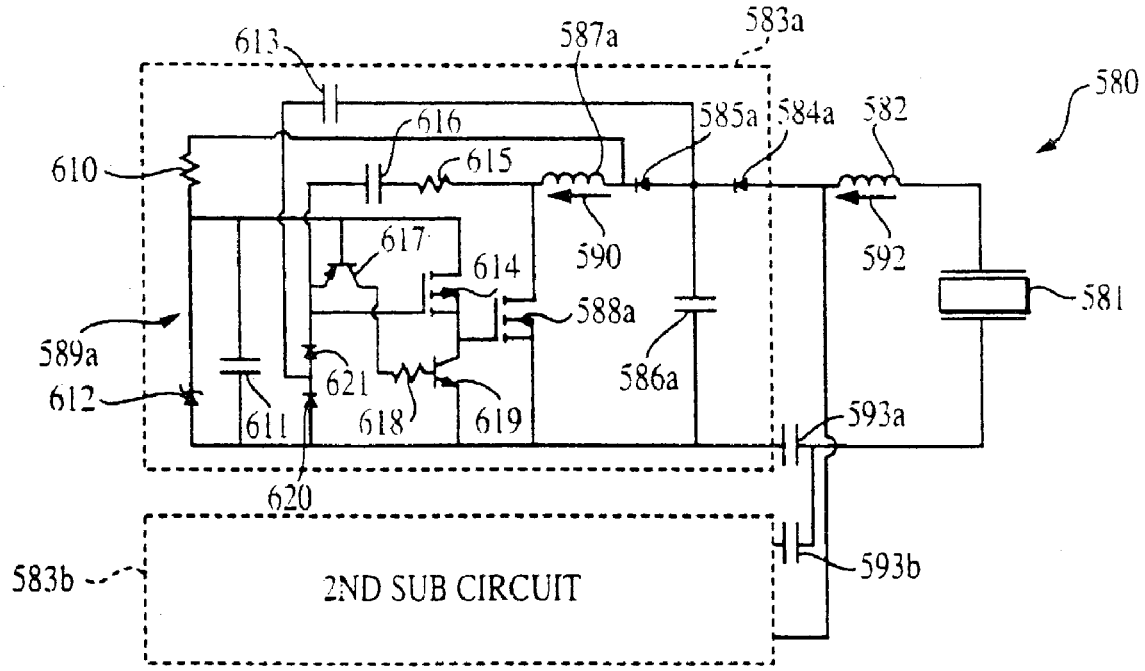
FIG. 34 is a circuit diagram of a control circuit of the circuit of FIG. 32.

Referring to FIG. 34, a preferred embodiment of the control circuit 589*a* is self-powered, requiring no external power. A capacitor 611 is charged through resistor 610 and/or through resistor 615, capacitor 616, diode 621, and transistor 617, during phase I of the circuit's operation (i.e., while the voltage across the transducer is increasing). A Zener diode 612 prevents the voltage of capacitor 611 from exceeding desired limits. When the voltage across capacitor 586*a* begins to decrease, a high-pass filter (resistor 615 and capacitor 616) turns on a p-channel MOSFET 614. MOSFET 614 then turns on switch 588*a*, using the energy from capacitor 611 to power the gate of switch 588*a*. Current 590 flowing through inductor 587*a* and switch 588*a* causes the voltage across capacitor 586*a* to decrease rapidly. As the voltage across capacitor 586*a* decreases, current 592 begins to flow from transducer 581 through inductor 582 and diode 584*a* to capacitor 586*a*. As current 592 becomes larger than current 590, the voltage across capacitor 586*a* stops decreasing and begins to increase, at which point, a high-pass filter (capacitor 613) turns off MOSFET 614 through diode 621, and turns on transistor 617 which causes transistor 619 to turn on. As a result, switch 588*a* is turned off. The process is repeated several times, causing the voltage across transducer 581 to decrease in a number of steps, as shown in FIG. 33.

Figure 3A:
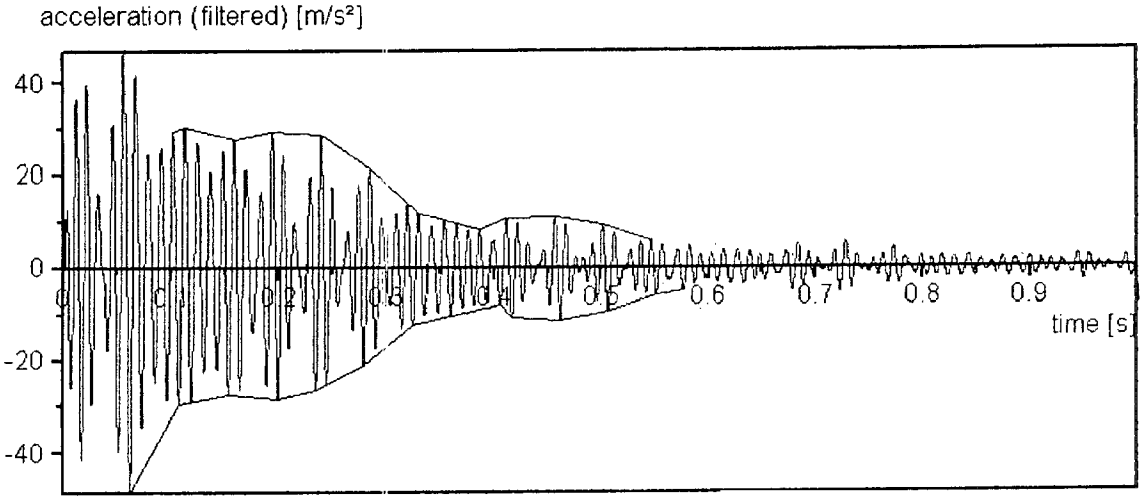
FIG. 3A is a diagram illustrating the torsional acceleration of a torsional oscillation of a ski of the present invention versus time.
Figure 3C:
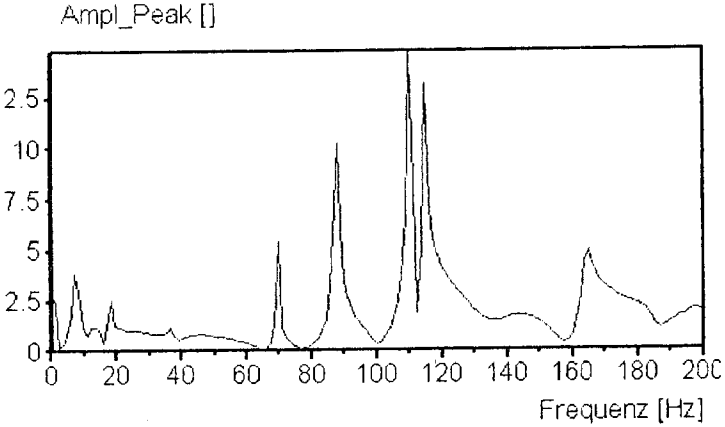
FIG. 3C is a diagram illustrating the oscillation amplitude of the oscillating ski of the present invention versus frequency.
Figure 3B:
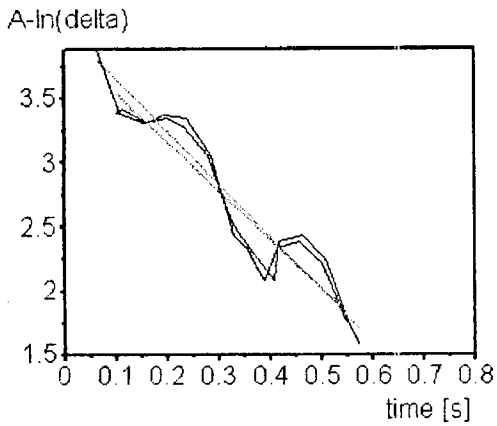
FIG. 3B is a diagram showing the logarithmic decrement Δ (delta) versus time based on the acceleration values indicated in FIG. 3A.
Figure 4A:
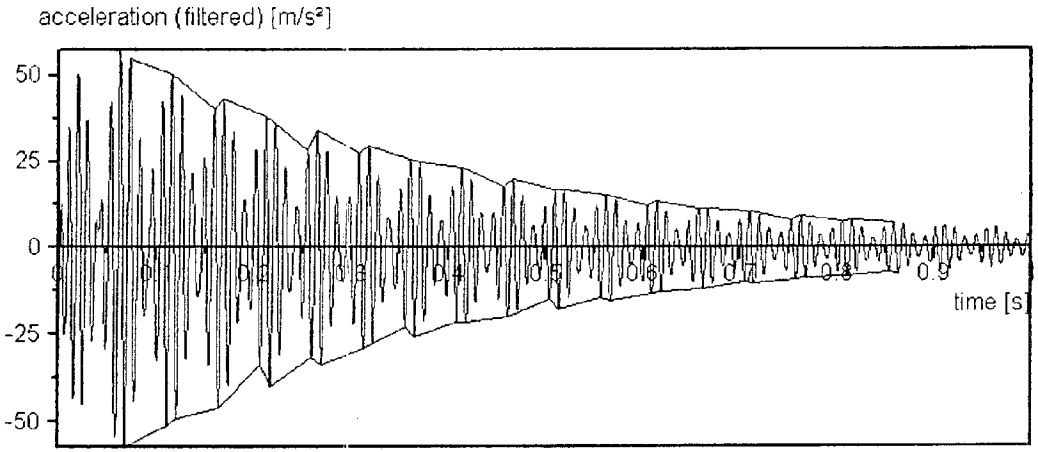
FIG. 4A is a diagram of the acceleration of a prior art ski versus time.
Figure 4C:
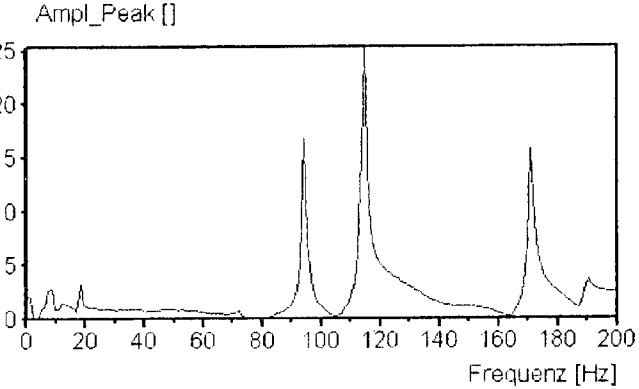
FIG. 4C is a diagram illustrating the oscillation amplitude of the prior art ski versus frequency.
Figure 4B:
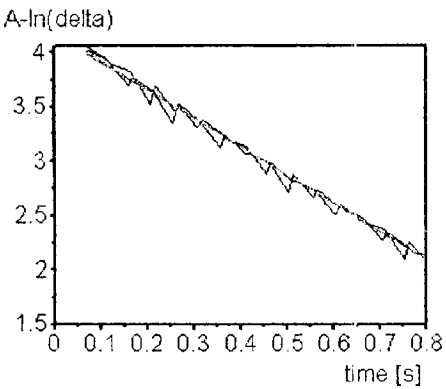
FIG. 4B is a diagram showing the logarithmic decrement Δ (delta) versus time based on the acceleration values indicated in FIG. 4A.

The characteristics of the ski 2 of the present invention are illustrated in FIGS. 3A, 3B and 3C, while in FIGS. 4A, 4B and 4C the characteristics of the same ski without any transducer or electrical circuit are shown for comparison. The measurements illustrated in FIGS. 3A, 3B and 3C are based on the ski construction as described with reference to FIGS. 1 and 2. For the measurements shown in FIGS. 3 and 4 a torsional oscillation had been induced in the ski, whereupon the oscillation behavior was analyzed. In FIGS. 3A and 4A the waveform of the oscillation is illustrated as acceleration versus time for the ski 2 of the present invention and the same ski without the transducers and electrical circuit, respectively. As can be seen from a comparison of these diagrams, the oscillation induced in the ski of the present invention is considerably faster reduced (FIG. 3A) than in the prior art ski (FIG. 4A), i.e. the ski is actively stiffened by counter-acting with the transducers and the electrical circuit against the deformation due to the oscillation. This can also be seen from FIGS. 3B and 4B, where the respective logarithmic decrements Δ (delta) for both oscillation are shown. More precisely, the logarithmic decrement Δ (delta) is in the ski of the present invention calculated to be about 3.95, whereas in the prior art ski the logarithmic decrement Δ (delta) is approximately 2.60. An advantageous effect can also be recognized with respect to the amplitude of the oscillation which is in accordance with the present invention at an eigenfrequency of about 88.0 Hz about 10.30 units, while in the prior art ski the amplitude at an eigenfrequency of about 94.1 Hz is 16.75 units. This is shown in FIGS. 3C and 4C, respectively. This measurements lead to a damping ratio of about 0.0071 for the ski of the present invention and to a damping ratio of about 0.0044 for the prior art ski.

Generally, in accordance with the present invention, the at least one transducer and the electrical circuit are adapted to stiffen the board in a frequency range between 60 and 180 Hz, preferably between 85 and 120 Hz. Furthermore, the transducer(s) and the electrical circuit are preferably adapted to reduce the oscillation amplitude by a factor of at least 1.5, preferably at least 2.0. The damping ratio is preferably in the range of between 0.0050 and 0.0100, and more preferred between 0.0065 and 0.0075.

The stiffening effect of the board according to the present invention ecxeeds mere dampening since the transducer and the electrical circuit not only influence the material characteristics of the board by dissipating electrical energy, but the transducer(s) in combination with the self-powered electrical circuit actively counter-act against the oscillation movement of the torsional oscillation. Based on this concept the improved performance characteristics of the board of the present invention can be achieved.

The invention claimed is:

1. A board for performing skiing sports comprising a longitudinally extending body having a longitudinal axis, at least one transducer actuator laminated to the body and converting upon deformation of the body mechanical power to electrical power, and an electrical circuit connected across the transducer actuator, said electrical circuit supplying power to the transducer actuator, wherein all electrical power supplied to the transducer actuator is derived from power extracted from mechanical deformation of the transducer actuator and the transducer actuator converts said electrical power to mechanical power, said mechanical power being adapted to actively stiffen said board.

2. The board of claim 1, wherein the electrical connection between the at least one transducer actuator and the electrical circuit is established by means of laminated flex circuits.

3. The board of claim 1, wherein the at least one transducer actuator has an elongated shape and is laminated to the body adjacent a running surface of the board.

4. The board of claim 1, wherein two transducer actuators are provided on the body of the board that are electrically connected to the same electrical circuit.

5. The board of claim 3, wherein each of the elongated transducer actuators is provided on the body of the board under an angle of about 30° to 60° with respect to the longitudinal axis of the board.

6. The board of claim 4, wherein the two transducer actuators are provided perpendicularly with respect to one another and each obliquely with respect to the longitudinal axis of the body.

7. The board of claim 1, wherein the at least one transducer actuator is arranged at an antinodal point of a torsional oscillation and the electrical circuit is adapted to minimize or suppress a first mode of said torsional oscillation.

8. The board of claim 1, wherein the at least one transducer actuator and the electrical circuit are adapted to stiffen the board in a frequency range between 60 and 180 Hz.

9. The board of claim 1, wherein the at least one transducer actuator and the electrical circuit are adapted to reduce the oscillation amplitude by a factor of at least 1.5.

10. The board of claim 1, having a damping ratio in the range of between 0.0050 and 0.01 00.

11. The board of claim 1, wherein the transducer actuator comprises fibrous transducer material.

12. The board of claim 1, wherein the electrical circuit comprises a storage element for storing power extracted from the transducer actuator.

13. The board of claim 1, wherein the transducer actuator is at least one of a piezoelectric, an antiferroelectric, an electrostrictive, a piezomagnetic, a magnetostrictive, a magnetic shape memory and a piezoceramic material.

14. The board claim 1, wherein the at least one transducer actuator has a size of about 8 to 16 $cm^2$.

15. The board of claim 1, wherein the transducer actuator is a composite comprising a series of flexible, elongated fibers arranged in a parallel array.

16. The board of claim 1, wherein two transducer actuators are spaced from one another in the longitudinal direction of the board.

17. A method of stiffening a board for performing skiing sports comprising the steps of:

a) converting mechanical power induced in at least one transducer actuator laminated to the board upon deformation of the board to electrical power;

b) supplying the electrical power to an electrical circuit connected across the transducer actuator;

c) supplying power from the electrical circuit to the transducer actuator, wherein all electrical power supplied to the transducer actuator is derived from power extracted from mechanical deformation of the transducer actuator; and d) converting the electrical power to mechanical power by the transducer actuator so that said board is actively stiffened by counter-action of the transducer actuator against the deformation.

18. The method of claim 17, wherein the board is the board of claim 1.

19. A method of manufacturing the board of claim 1, comprising the steps of:

a) providing a recess in the board for receiving the electrical circuit;

b) mounting the electrical circuit into the recess;

c) providing the at least one transducer actuator and an electrical connection between the transducer actuator and the electrical circuit onto the board; and d) laminating the transducer actuator and the electrical circuit to the board by applying pressure and/or heat.

20. The method of claim 19, wherein the recess is provided in a binding receiving area of the board, preferably in between two binding receiving areas for a front part and a rear part of a binding.

21. The method of claim 19, wherein two transducer actuators are provided on the board, each being inclined with respect to a longitudinal axis of the board so that the transducer actuators are arranged perpendicularly with respect to one another.

* * * * *